US006899362B1

(12) United States Patent
Weinerman et al.

(10) Patent No.: US 6,899,362 B1
(45) Date of Patent: May 31, 2005

(54) LINKAGE ASSEMBLY FOR OPERATING ONE OR MORE LATCHES

(75) Inventors: Lee S. Weinerman, Medina, OH (US); Scott A. Arthurs, Brunswick, OH (US); Arthur J. Kuminski, Parma, OH (US)

(73) Assignee: The Eastern Company, Cleveland, OH (US)

( * ) Notice: Subject to any disclaimer, the term of this patent is extended or adjusted under 35 U.S.C. 154(b) by 0 days.

(21) Appl. No.: 10/227,929

(22) Filed: Aug. 26, 2002

Related U.S. Application Data

(63) Continuation-in-part of application No. 29/160,445, filed on May 10, 2002, now Pat. No. Des. 471,427, and a continuation-in-part of application No. 29/159,991, filed on May 2, 2002, now Pat. No. Des. 467,786, and a continuation-in-part of application No. 29/152,851, filed on Dec. 27, 2001, now Pat. No. Des. 471,426, and a continuation-in-part of application No. 29/152,852, filed on Dec. 27, 2001, now Pat. No. Des. 463,247, and a continuation-in-part of application No. 29/142,044, filed on May 17, 2001, now Pat. No. Des. 464,555, and a continuation-in-part of application No. 29/131,819, filed on Oct. 27, 2000, now Pat. No. Des. 447,042, and a continuation-in-part of application No. 09/698,416, filed on Oct. 27, 2000, now Pat. No. 6,454,320, which is a continuation-in-part of application No. 29/113,063, filed on Oct. 28, 1999, now Pat. No. Des. 445,015, application No. 10/227,929, which is a continuation-in-part of application No. 29/160,445, and a continuation-in-part of application No. 29/159,991, and a continuation-in-part of application No. 29/152,852, and a continuation-in-part of application No. 29/152,851, and a continuation-in-part of application No. 29/142,044, which is a continuation-in-part of application No. 09/698,416, application No. 10/227,929, which is a continuation-in-part of application No. 29/159,991, and a continuation-in-part of application No. 29/152,852, and a continuation-in-part of application No. 29/152,851, and a continuation-in-part of application No. 29/142,044, which is a continuation-in-part of application No. 09/698,416, application No. 10/227,929, which is a continuation-in-part of application No. 29/152,851, which is a continuation-in-part of application No. 09/698,416, and a continuation-in-part of application No. 29/131,819, and a continuation-in-part of application No. 29/113,063, application No. 10/227,929, which is a continuation-in-part of application No. 29/152,852, which is a continuation-in-part of application No. 09/698,416, and a continuation-in-part of application No. 29/131,819, and a continuation-in-part of application No. 29/113,063.

(60) Provisional application No. 60/377,117, filed on May 2, 2002.

(51) Int. Cl.[7] ..... E05B 3/00

(52) U.S. Cl. ..... 292/336.3; 292/38; 292/50; 292/DIG. 37; 70/79; 70/208; 70/360; 70/DIG. 20

(58) Field of Search ..... 292/336.3, 2.8, 292/27, 26, 34, 35, 36, 38, 46, 47, 48, 50, DIG. 37, 30, 25, 37, 49, 53, 33, 45; 70/79, 208, 360, DIG. 20

(56) References Cited

U.S. PATENT DOCUMENTS

| | | | | |
|---|---|---|---|---|
| 113,070 | A | 3/1871 | Loeffelholz et al. | 292/34 |
| 417,589 | A | 12/1889 | Rose | 292/40 |

(Continued)

*Primary Examiner*—Daniel P. Stodola
*Assistant Examiner*—Carlos Lugo
(74) *Attorney, Agent, or Firm*—David A. Burge

(57) ABSTRACT

A linkage assembly includes a frame, an arm movement coordinating member slidably supported by the frame, and a pair of arms pivotally connected to the frame and connected to the coordinating member to ensure that the arms pivot in unison when the coordinating member is slided relative to the frame by depressing a push button that is connected to the frame for translation relative thereto. Either of the arms can be link-connected to a latch assembly for operating either a single latch assembly or for concurrently operating a pair of latch assemblies in response to depression of the push button. An optional emergency release cable may connect with the arm movement coordinating member to facilitate latch operation from inside a tonneau cover of a pickup truck or the like that is held closed by the latch or latches.

48 Claims, 18 Drawing Sheets

U.S. PATENT DOCUMENTS 480,148 A 8/1892 Theby ..... 292/36
491,824 A 2/1893 Walker ..... 200/61.64
767,567 A 8/1904 Keil ..... 292/127
876,300 A 1/1908 Couret ..... 292/135
925,455 A 6/1909 Campbell ..... 70/81
1,018,077 A 2/1912 Petterson ..... 70/150
1,058,346 A 4/1913 Berstler ..... 292/21
1,174,652 A 3/1916 Banks ..... 292/36
1,368,141 A 2/1921 Hagstrom ..... 292/34
1,531,605 A 3/1925 Gaynor ..... 200/535
1,556,864 A 10/1925 Mendenhall ..... 292/33
1,571,453 A 2/1926 Maxon ..... 292/170
1,672,901 A 6/1928 North ..... 292/227
1,908,980 A 5/1933 Heyel ..... 70/120
1,965,939 A 7/1934 Jacobi ..... 70/29
2,059,479 A 11/1936 North ..... 292/127
2,322,040 A 6/1943 Maruri ..... 70/145
2,683,978 A 7/1954 Jacobi ..... 70/360
2,705,884 A 4/1955 Craig ..... 70/264
2,728,214 A 12/1955 Craig ..... 70/149
2,755,519 A 7/1956 Xan Der ..... 20/52
2,772,908 A 12/1956 Craig ..... 292/280
2,911,247 A 11/1959 Corbin ..... 292/48
2,987,907 A 6/1961 Cockburn et al. ..... 70/135
3,054,634 A 9/1962 Westerdale ..... 292/336.3
3,545,799 A 12/1970 Gertsfeld ..... 292/34
3,602,017 A 8/1971 Bauer ..... 70/78
3,834,780 A 9/1974 McClellan et al. ..... 312/219
3,883,164 A * 5/1975 Galbreath et al. ..... 292/92
3,964,280 A 6/1976 Kelton ..... 70/84
4,059,296 A 11/1977 Panourgias ..... 285/312
4,488,669 A 12/1984 Waters ..... 224/273
4,601,499 A 7/1986 Kim ..... 292/36
4,884,831 A * 12/1989 Emon ..... 292/38
4,892,338 A 1/1990 Weinerman et al. ..... 292/35
4,951,486 A * 8/1990 Braun et al. ..... 70/208
4,978,152 A 12/1990 Bisbing ..... 292/169
D313,337 S 1/1991 Haskell ..... D8/336
5,042,853 A 8/1991 Gleason et al. ..... 292/126
D324,635 S 3/1992 Weinerman et al. ..... D8/331
5,265,450 A * 11/1993 Doyle ..... 70/118
5,308,126 A 5/1994 Weger, Jr. et al. ..... 292/53
5,346,266 A 9/1994 Bisbing ..... 292/64
5,439,260 A 8/1995 Weinerman et al. ..... 292/48
5,445,326 A * 8/1995 Ferro et al. ..... 292/336
5,526,660 A 6/1996 Bennett et al. ..... 70/208
D371,300 S 7/1996 Mordick ..... D8/343
5,564,295 A 10/1996 Weinerman et al. ..... 70/208
5,586,458 A 12/1996 Weinerman et al. ..... 70/208
5,595,076 A 1/1997 Weinerman et al. ..... 70/208
5,611,224 A 3/1997 Weinerman et al. ..... 70/208
5,816,630 A 10/1998 Bennett et al. ..... 292/341.17
5,884,948 A 3/1999 Weinerman et al. ..... 292/216
5,984,383 A 11/1999 Parikh et al. ..... 292/121
6,012,747 A 1/2000 Takamura et al. ..... 292/216
D429,141 S 8/2000 Antonucci et al. ..... D8/331
6,113,160 A 9/2000 Johansson et al. ..... 292/169
D432,389 S 10/2000 Johansson et al. ..... D8/331
6,231,091 B1 5/2001 Gleason et al. ..... 292/34
D447,042 S 8/2001 Weinerman et al. ..... D8/330
6,349,577 B1 2/2002 Hansen et al. ..... 70/159

* cited by examiner

LINKAGE ASSEMBLY FOR OPERATING ONE OR MORE LATCHES

REFERENCE TO PROVISIONAL APPLICATION

This application claims the benefit of U.S. provisional application Ser. No. 60/377,117 entitled LINKAGE ASSEMBLY FOR OPERATING ONE OR MORE LATCHES filed May 2, 2002 by Lee S. Weinerman et al the disclosure of which is incorporated herein by reference.

CROSS-REFERENCE TO RELATED APPLICATIONS

The present application is a continuation-in-part of one utility application, and also is a continuation-in-part of each of five design applications, namely:

1) Utility application Ser. No. 09/698,416 filed Oct. 27, 2000 now U.S. Pat. No. 6,454,320 by Lee S. Weinerman et al entitled PUSH BUTTON OPERATORS FOR LATCHES AND LOCKS, AND LOCKING SYSTEMS EMPLOYING LOCKABLE PUSH BUTTON OPERATORS, referred to herein as the "Push Button Operator Utility Case" or as the "Eberhard Patent");
2) Design application Ser. No. 29/160,445 filed May 10, 2002 now U.S. Design Pat. No. D471,427 by Lee S. Weinerman et al entitled LINKAGE ASSEMBLY FOR USE WITH PUSH BUTTON LATCH AND LOCK OPERATING ASSEMBLIES;
3) Design application Ser. No. 29/159,991 filed May 2, 2002 now U.S. Design Pat. No. D467,786 by Lee S. Weinerman et al entitled LINKAGE ASSEMBLY FOR USE WITH PUSH BUTTON LATCH AND LOCK OPERATING ASSEMBLIES;
4) Design application Ser. No. 29/152,852 filed Dec. 27, 2001 now U.S. Design Pat. No. D463,247 by Lee S. Weinerman et al entitled PORTIONS OF A CLAMP BRACKET ASSEMBLY FOR USE WITH PUSH BUTTON LATCH AND LOCK OPERATING ASSEMBLIES;
5) Design application Ser. No. 29/152,851 filed Dec. 27, 2001 now U.S. Design Pat. No. D471,426 by Lee S. Weinerman et al entitled PORTIONS OF A CLAMP BRACKET ASSEMBLY FOR USE WITH PUSH BUTTON LATCH AND LOCK OPERATING ASSEMBLIES; and,
6) Design application Ser. No. 29/142,044 filed May 17, 2001 now U.S. Design Pat. No. D464,555 by Lee S. Weinerman et al entitled PORTIONS OF A CLAMP BRACKET ASSEMBLY FOR USE WITH PUSH BUTTON LATCH AND LOCK OPERATING ASSEMBLIES.

The design applications identified above were filed as continuations-in-part of one or more earlier-filed design applications; therefore, the "continuing data" of the present application includes more than the information that is set out above. In particular:

A) The aforementioned design application Ser. No. 29/160,445 filed May 2, 2002 by Lee S. Weinerman et al entitled LINKAGE ASSEMBLY FOR USE WITH PUSH BUTTON LATCH AND LOCK OPERATING ASSEMBLIES was filed as a continuation-in-part of the utility application identified above and as a continuation-in-part of each of the four other design cases identified above;
B) The aforementioned design application Ser. No. 29/159,991 filed May 2, 2002 by Lee S. Weinerman et al entitled LINKAGE ASSEMBLY FOR USE WITH PUSH BUTTON LATCH AND LOCK OPERATING ASSEMBLIES was filed as a continuation-in-part of the utility application identified above and as a continuation-in-part of each of the three earlier-filed design cases identified above;
C) The aforementioned design application Ser. No. 29/152,852 was filed as a continuation-in-part of the aforementioned design application Ser. No. 29/142,044 filed May 17, 2001 by Lee S. Weinerman et al entitled PORTIONS OF A CLAMP BRACKET ASSEMBLY FOR USE WITH PUSH BUTTON LATCH AND LOCK OPERATING ASSEMBLIES;
D) The aforementioned design application Ser. No. 29/152,851 was filed as a continuation-in-part of the aforementioned design application Ser. No. 29/142,044 filed May 17, 2001 by Lee S. Weinerman et al entitled PORTIONS OF A CLAMP BRACKET ASSEMBLY FOR USE WITH PUSH BUTTON LATCH AND LOCK OPERATING ASSEMBLIES; and,
E) The aforementioned design application Ser. No. 29/142,044 was filed as a continuation-in-part of design application Ser. No. 29/131,819 filed October 27, 2000 by Lee S. Weinerman et al entitled CLAMP BRACKET ASSEMBLY WITH J-SHAPED ARMS FOR USE WITH PUSH BUTTON LATCH AND LOCK OPERATING ASSEMBLIES issued Aug. 28, 2001 as Patent D-447,042 (referred to herein as the "Push Button Operator Design Case"), which was filed as a continuation-in-part of application Ser. No. 29/113,063 filed Oct. 28, 1999 by Lee S. Weinerman et al entitled FRONT EXTERIOR PORTION OF A LATCH OR LOCK HOUSING WITH PUSH BUTTON OPERATOR issued Jul. 17, 2001 as Patent D-445,015.

The disclosures of all of the aforementioned utility and design applications are incorporated herein by reference.

BACKGROUND OF THE INVENTION

The present invention relates to latches that are operated by push button assemblies of the type having depressible push buttons supported by housings. More particularly, the present invention relates to a linkage assembly having a frame that is connectable to the housing of a push button assembly and that pivotally supports a pair of arms that are connectable to one or more links for operating one or more latches in response to movement of a push button actuator along a path of movement that is defined by the housing of the push button assembly.

The present invention provides an improved linkage assembly that can be substituted for the linkage assembly that is disclosed in FIGS. 12–23 of the Eberhard Patent to perform the same functions as are performed by the linkage assembly disclosed in FIGS. 12–23 of the Eberhard Patent. The Eberhard Patent's discussion of the uses to which the linkage assembly of FIGS. 12–23 can be put is equally applicable to the linkage assembly of the present invention.

The present invention provides an improved linkage assembly that also can be substituted for the linkage assembly that is disclosed in U.S. Pat. No. 6,231,091 issued May 15, 2001 to Gleason et al entitled CONTROL MECHANISM FOR OPERATING A LATCH (referred to herein as the "Tri/Mark Patent") to perform the same functions as are performed by the linkage assembly disclosed in the Tri/Mark Patent, the disclosure of which is incorporated herein by reference. The Tri/Mark Patent's discussion of the uses to which the linkage assembly disclosed therein can be put is equally applicable to the linkage assembly of the present invention.

The linkage assemblies of the Eberhard Patent and the Tri/Mark Patent each include a frame that is designed to be installed on, or otherwise connected to, a housing of a push button assembly of the type having a housing that supports a push button actuator for sliding movement along a path of movement defined by the housing. The frame of the linkage assembly supports first and second arms for pivotal movement about first and second axes, respectively, that are located on opposite sides of the path of movement of the actuator. The arms have outer end regions that are connectable to links that operate remotely located latches, and inner end regions that define edge surfaces that are engaged by the actuator when the actuator moves along the path of movement.

Another characteristic that is shared by the linkage assemblies of the Eberhard and Tri/Mark Patents is that the first and second arms of each of these linkage assemblies move independently with respect to each other: there is no separate element—indeed, nothing at all—that coordinates the movement of the first and second arms of either of these linkages. Inasmuch as neither of these linkage assemblies is provided with any means for coordinating the movement of the first and second arms thereof, there likewise is nothing to ensure that, at the completion of operation of the push button actuator, both (or even one) of the first and second arms returns to its normal, non-operated position. Thus, at the completion of an unlatching movement of both arms, it is quite possible that only one of the arms may return fully to its nonoperated position, or that neither of the arms may return fully to its non-operated position. The result of this uncoordinated return movement of the arms may be that, when the push button actuator is depressed to engage and pivot the arms, one of the arms may be engaged by the actuator well in advance of when the other arm is engaged by the actuator.

Inasmuch as the linkage assemblies of the Eberhard and Tri/Mark Patents are intended to operate in a manner that provides coordinated pivoting of the arms of these assemblies in unison to effect concurrent operation of the latches that are link-connected to these arms, the fact of the matter is that these neither of these linkage assemblies includes a mechanical device for ensuring that the arms move in unison. If the independently movable arms fail to move in unison in a coordinated manner, this can result in inconsistent operation that may bring with it impositions of larger than intended forces on the elements of the linkage assemblies that may eventually cause binding, jamming, wear and/or premature operational failure.

The absence of any arm-interconnecting element in the linkage assemblies of the Eberhard and Tri/Mark Patents to coordinate the movements of the arms of these assemblies has presented a dilemma to designers that has not been easy to resolve without significantly increasing the overall dimensions of the linkage assemblies. Because customers who purchase these very compactly designed linkage assemblies often use these assemblies in tight quarters in close juxtaposition to other mechanical components and, in some instances, enclose these assemblies with closely fitted covers, it is important that any design changes that are made in an effort to enhance the performance of these assemblies not cause the improved linkage assemblies to occupy significantly more space or to assume significantly different configurations that prevent the improved linkage assemblies from being substituted for linkage assemblies of the type disclosed in the Eberhard and Tri/Mark Patents.

Because the linkage assemblies of the Eberhard and Tri/Mark Patents are already quite compact and already are designed to occupy a minimum of space, adding components to these assemblies to coordinate the movement of the first and second arms of these assemblies has provided a daunting design challenge. While a number of design approaches have been tried in an effort to coordinate the movement of the arms of these linkage assemblies, one approach after another has had to be rejected because it caused an unacceptable increase in the space occupied by the linkage assembly, or because it caused an unacceptable change in the dimensions or configuration of the linkage assembly, or, quite importantly, because it failed to provide adequate arm movement (in response to about a half inch or less of travel of a push button actuator) to move latch operating links (that are connected to the arms and to latches that are to be operated in response to depression of a push button actuator) sufficiently to operate the latches that are intended to be operated by the linkage assembly.

Still another drawback of the linkage assemblies disclosed in the Eberhard and Tri/Mark Patents has been the absence of a single element within these assemblies to which an emergency release cable can be connected to enable these linkages to be operated from inside a tonneau covers or from inside large tool boxes or other enclosures on which these linkage assemblies may be installed. If these linkage assemblies could be provided with an element that coordinates the pivotal movement of the arms to ensure that their "operating" and "return" movements take place concurrently and in unison, perhaps an emergency release cable could be attached to the arm-movement-coordinating element to provide a way in which a person trapped within the confines of a tonneau cover, or tool box, or other latched enclosure could release the latches thereof to escape.

SUMMARY OF THE INVENTION

The present invention provides an linkage assembly that includes an arm-movement coordinating element to overcome the foregoing and other drawbacks of the prior art. A linkage assembly is provided that offers coordinated movement of its arms in unison while retaining much of the same general configuration and the compactness of size that is offered by the linkage assemblies disclosed in the referenced Eberhard and Tri/Mark Patents—a linkage assembly that can, therefore, be substituted for the linkage assemblies of the Eberhard and Tri/Mark Patents without requiring much, if any, rearrangement of other components due to significant differences in size or shape.

Whereas the linkage assemblies of the Eberhard and Tri/Mark patents have arms that are separately directly engaged by push button actuators, linkage assemblies embodying the preferred practice of the present invention have arms that are not directly engaged by a push button actuator and that are not independently moved by the actuator. The linkage assembly of the present invention provides a frame-supported slide that is directly engaged by a push button actuator and that translates along a path of travel defined by the frame in response to movement of the actuator along a path of movement that aligns with the path of travel of the slide.

Instead of utilizing direct engagement of the arms by a push button actuator to effect arm movement in response to actuator movement, the present invention employs a slide that is connected by a pin-like formation to the arms to coordinate the movement of the arms; and, it is the slide that is directly engaged and moved by the push button actuator, not the arms themselves. Instead of utilizing direct engagement of the arms with stops that are defined by the frame to limit ranges of permitted pivotal movement of the arms, the present invention utilizes interactions of the slide with the frame to limit the range of travel of the slide which, in turn, limits the range of pivotal movement of the arms due to the provision of a pinned type of connection between the slide and the arms that serves to coordinate the movements of the arms with movements of the slide, and that prevents arm movement when movement of the slide is prevented.

The "pinned" connection of the arms to the slide may be effected by utilizing a separate pin connected to the slide that extends through openings formed in overlapping inner end regions of the arms. However, in preferred practice, the "pinned" connection of the arms to the slide is effected by utilizing a die-cast slide that has a pin-shaped formation that extends through openings formed in overlapping inner end regions of the arms.

In the linkage assembly of the present invention, it is the slide's engagement with the frame that serves to limit the range of movement of the arms, not the arms' independent engagement with the frame. Thus, the arms are not separately and independently "stopped" at opposite ends of their range of pivotal movement by the frame; rather, the pivotal movement of the arms is "stopped" in a coordinated manner by the slide's engagements at opposite ends of its travel path with the frame.

Instead of providing no element to which an optional emergency release cable can be connected to concurrently pivot the arms to release the latches (as may be needed by a person who has been inadvertently locked beneath a tonneau cover or within the confines of a large tool box or other enclosure), the present invention provides access (at a location between overlapping inner end regions of the arms that are connected by a slide-carried pin) for an emergency release cable to be connected to the slide-carried pin formation that interconnects the slide and the arms for coordinated movement.

What the present invention offers, in a nutshell, is a linkage assembly that can be substituted for the linkage assemblies disclosed in the Eberhard and Tri/Mark Patents to perform the intended functions thereof in what is believed to be a more reliable and better coordinated manner while also offering the option of having an emergency release cable attached to its slide-carried pin —an emergency cable that can be grasped and pulled from the interior of an enclosure to release latches that are connected to the arms of the linkage assembly to open the enclosure.

The arm movement coordinating slide not only ensures that the arms pivot in unison to operate two latches that are connected by separate operating links to separate ones of the arms, but also ensures that the arms pivot in unison in returning to their non-operated positions. When utilized to operate a pair of link-connected latch assemblies that each carries a spring that biases its operating link toward a non-operated position, the arm movement coordinating slide can permit only one of these latch carried springs (in the event that the other of the latch carried springs is broken) to cause both of the operating links and both of the arms to return to their non-operated positions after the latches have been concurrently operated by pivoting the arms and moving the links to their operated positions.

In one form of the invention, a linkage assembly is provided for moving a plurality of latch-connected links to operate latches that are connected to the links in response to movement of a push button actuator along a path of movement defined by a housing to which the actuator is connected. The linkage assembly includes a frame adapted for connection to the housing; a first arm having a first outer end adapted for connection to one of the latch connected links, having a first inner end, and having a first central region located between the first inner end and the first outer end; and, a second arm having a second outer end adapted for connection to another of the latch connected links, having a second inner end, and having a second central region located between the second inner end and the second outer end. The linkage assembly additionally includes a slide connected to the frame and adapted for being engaged by the actuator to be moved along a path of travel defined by the frame in response to movement of the actuator along the path of movement defined by the housing; means for being connected to the frame, for defining a first pivot axis that extends through the first central region and about which the first arm pivots relative to the frame, and for defining a second pivot axis that extends through the second central region and about which the second arm pivots relative to the frame, wherein the first and second pivot axes are located on opposite sides of the path of travel of the slide at substantially equal distances from the path of travel of the slide, and wherein the first and second pivot axes extend substantially parallel to each other within a plane that extends substantially perpendicular to the path of travel of the slide; and, means for being connected to the slide, for defining a third pivot axis that substantially parallels the first and second pivot axes and that extends through the first inner end region of the first arm and through the second inner end region of the second arm and through the slide, and for concurrently pivoting the first and second arms about the first and second pivot axes, respectively, in response to movement of the slide along the path of travel of the slide to move the first and second outer end regions of the first and second arms to move the one and another links to operate latches connected to the one and another links in response to movement of the actuator along the path of movement of the actuator.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF PREFERRED EMBODIMENTS

Reference is made the aforementioned Push Button Operator Utility Case (application Ser. No. 09/698,416, the disclosure of which is incorporated herein by reference) which, at FIGS. 12–23, discloses a push button operator assembly 2132 with a linkage assembly 2500 connected thereto and having a frame 2510 that pivotally supports a pair of J-shaped arms 2600 with inner end regions 2610 having edges that are directly engaged by an actuator cam 2172 of the push button operator assembly 2132 for moving a pair of latch connected links that are indicated schematically by arrows 2900 and 2901. The linkage assembly of the present invention is substitutable for the linkage assembly 2500 disclosed in the referenced Push Button Operator Utility Application to serve the same functions as are served by the linkage assembly 2500. The linkage assembly of the present invention also may serve other useful functions such as providing a connection point for an emergency release cable, as will be described later herein.

Reference also is made to the aforementioned Tri/Mark U.S. Pat. No. 6,231,091 (the disclosure of which is incorporated herein by reference) which discloses a linkage assembly (referred to as a "control mechanism 10") that can be used with a push button assembly (referred to as an "actuator assembly 22"). The linkage assembly of the present invention can be used with push button assemblies of the type disclosed in the Tri/Mark Patent, and can be substituted for the linkage assembly disclosed in the Tri/Mark Patent.

Figure 1:
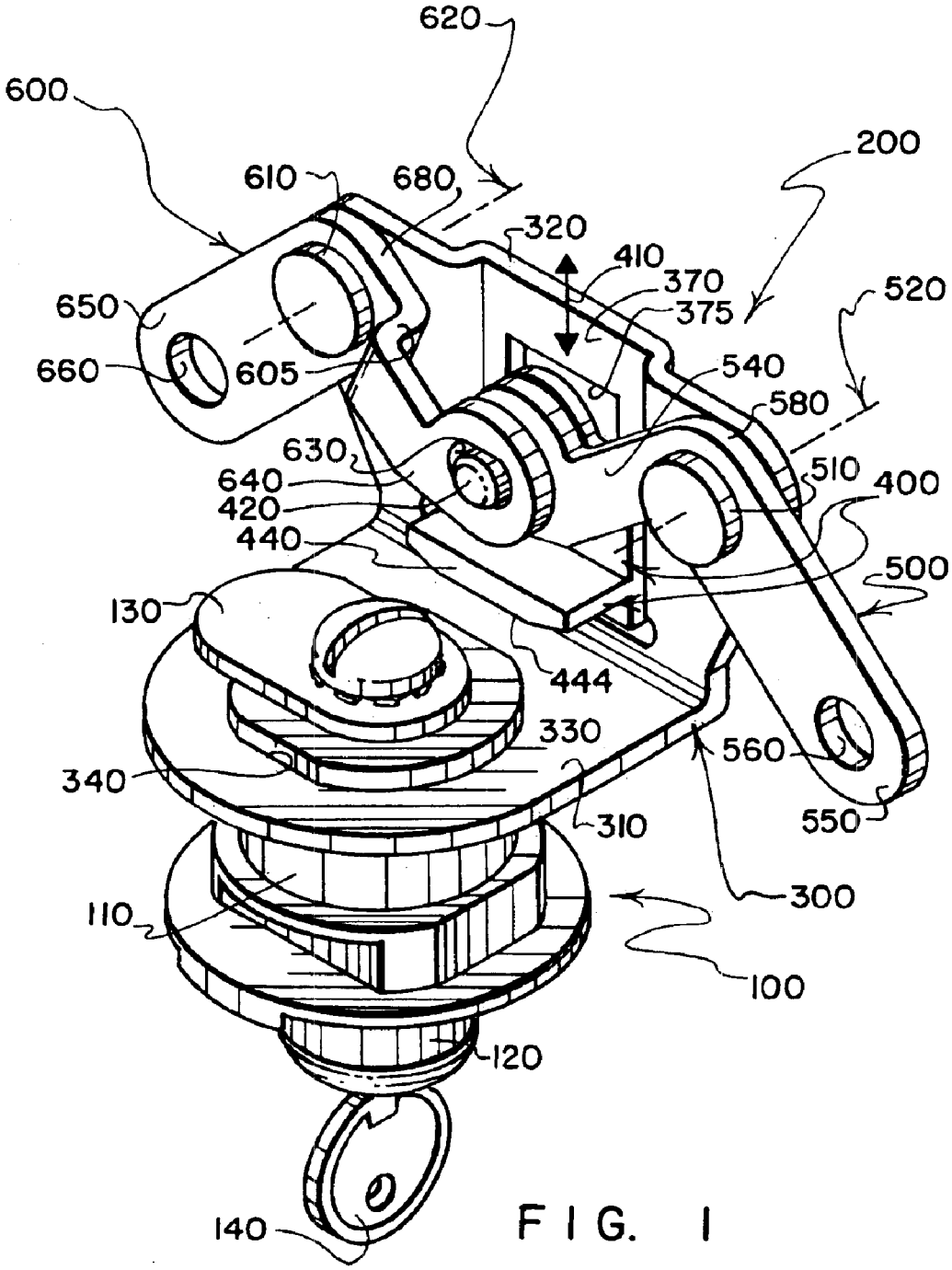
FIG. 1 is a perspective view showing a first form of linkage assembly embodying features of the present invention installed on a housing of a push button assembly, with an actuator cam of the push button assembly turned to a locked non-operated position by an inserted key, and with a pair arms of the linkage assembly in their extended, non-operated positions.

Referring to FIG. 1 of the present application, a push button assembly of the type disclosed in the referenced Push Button Operator Utility Case (also referred to herein as the "Eberhard Patent") is indicated generally by the numeral 100. The push button assembly 100 includes a generally cylindrical housing 110 having a rear end region to which a linkage assembly 200 is connected that embodies the preferred practice of the present invention.

Figure 3:
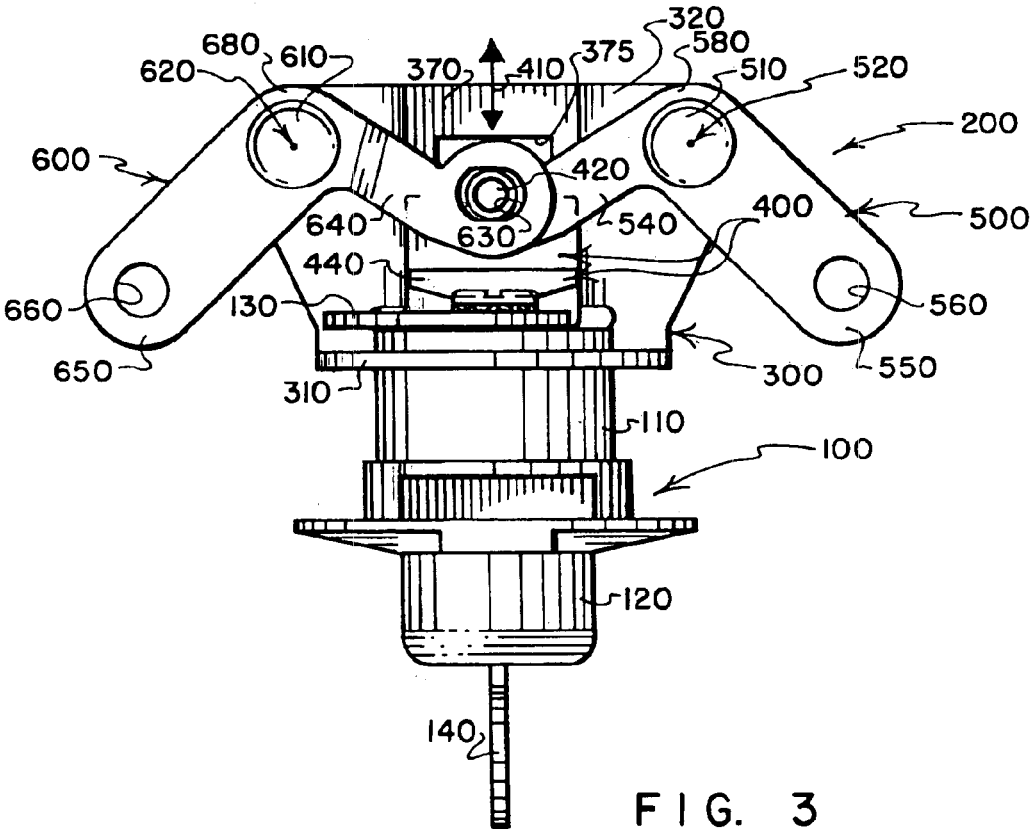
FIG. 3 is a front view thereof.
Figure 4:
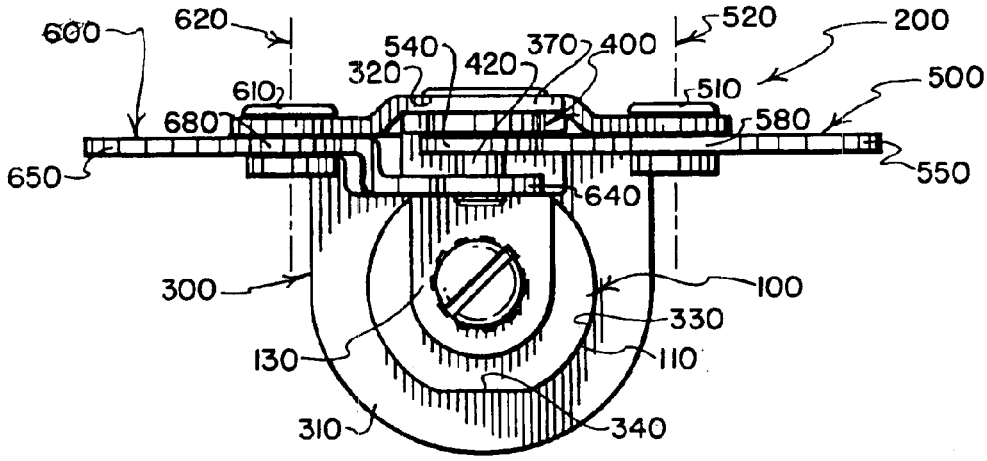
FIG. 4 is a top view similar to FIG. 2 but with the actuator cam of the push button assembly turned by the inserted key to an unlocked and non-operated position, and with arms of the linkage assembly still in their non-operated positions.
Figure 5:
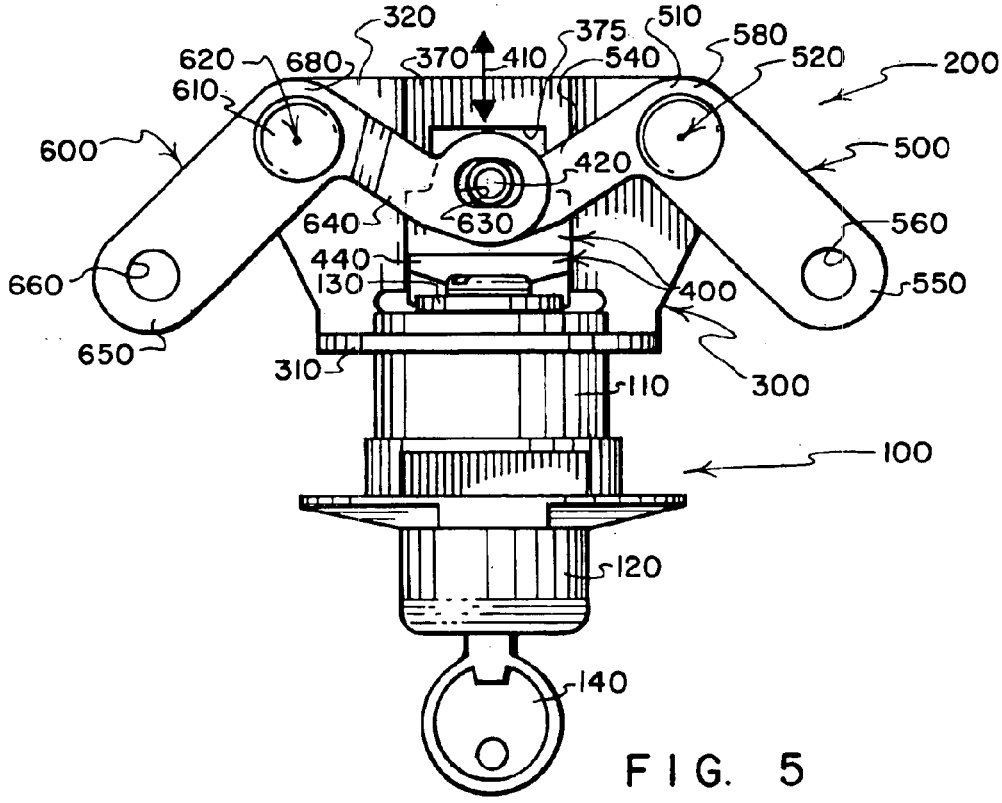
FIG. 5 is a front view thereof.
Figure 6:
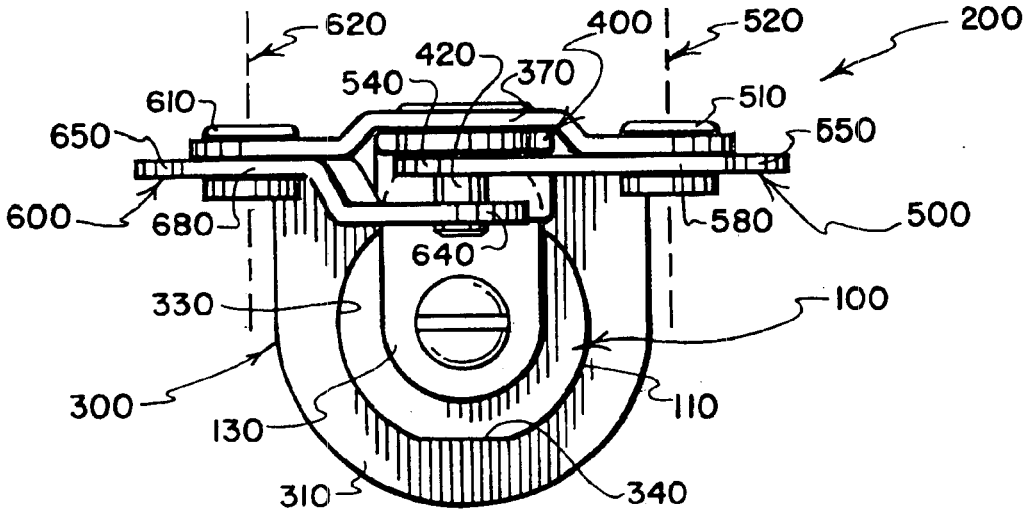
FIG. 6 is a top view similar to FIG. 4 but with the actuator of the push button depressed to move the actuator cam from the non-operated position of FIG. 4 to an operated position, and with the arms of the linkage assembly pivoted to their retracted, operated positions.
Figure 7:
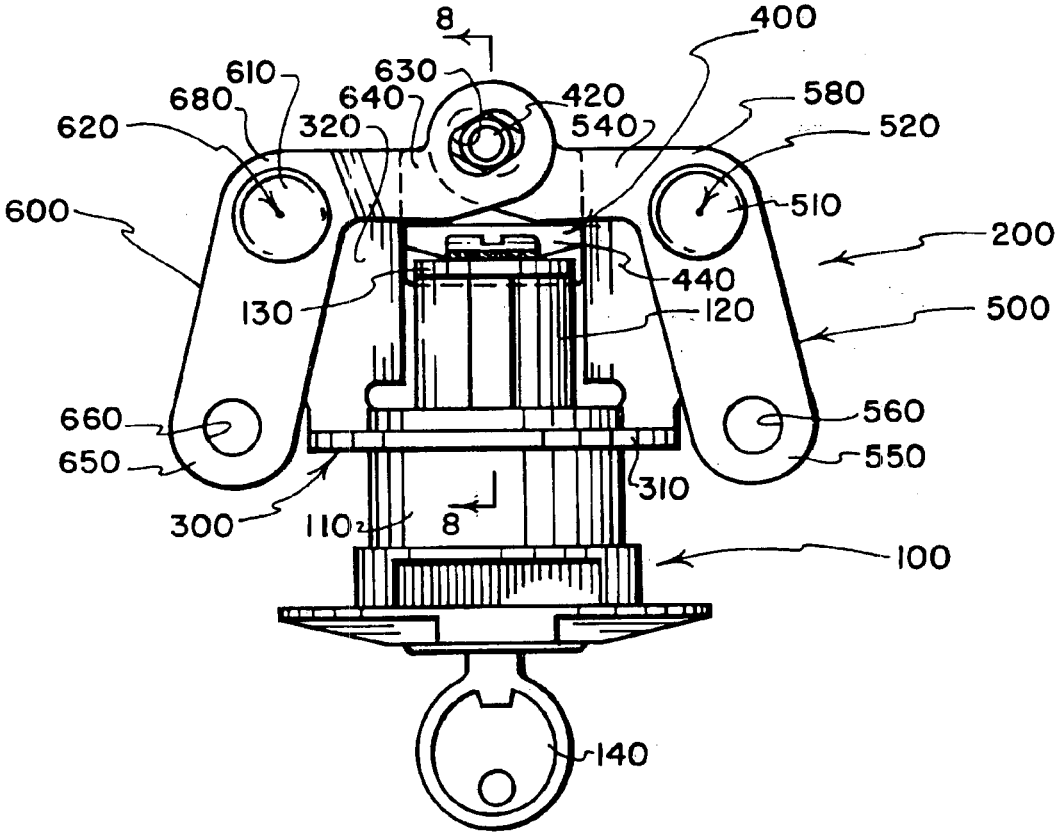
FIG. 7 is a front view thereof.

The push button assembly 100 has a push button actuator 120 that is shown in its normal, forwardly projecting, non-operated position in FIGS. 1, 3 and 5, and in its depressed, operated position in FIG. 7. The push button actuator 120 extends through the housing 110 to support an actuator cam 130 at its rear. The actuator cam 130 moves forwardly and rearwardly with the push button actuator 120, as can be seen by comparing the forward position of the actuator cam 130 in FIGS. 1, 3 and 5 with the rearward position of the actuator cam 130 in FIG. 7.

Figure 2:
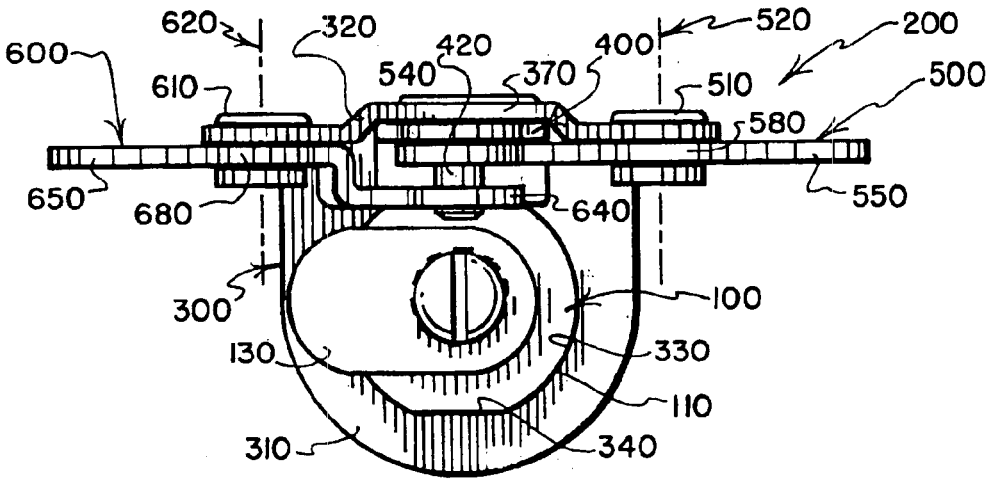
FIG. 2 is a top view thereof.

The actuator cam 130 can be pivoted between a locked position depicted in FIGS. 1–3 to an unlocked position shown in FIGS. 4–7 by rotating an appropriately configured key 140 that has been inserted into a keyway of the push button actuator 120. When in its unlocked position, rearward movement of the actuator cam 130 will bring the actuator cam 130 into engagement with a slide 400 of the linkage assembly 200 to effect coordinated pivotal movement in unison of a pair of arms 500, 600 of the linkage assembly 200, as will be described shortly.

Figure 24:
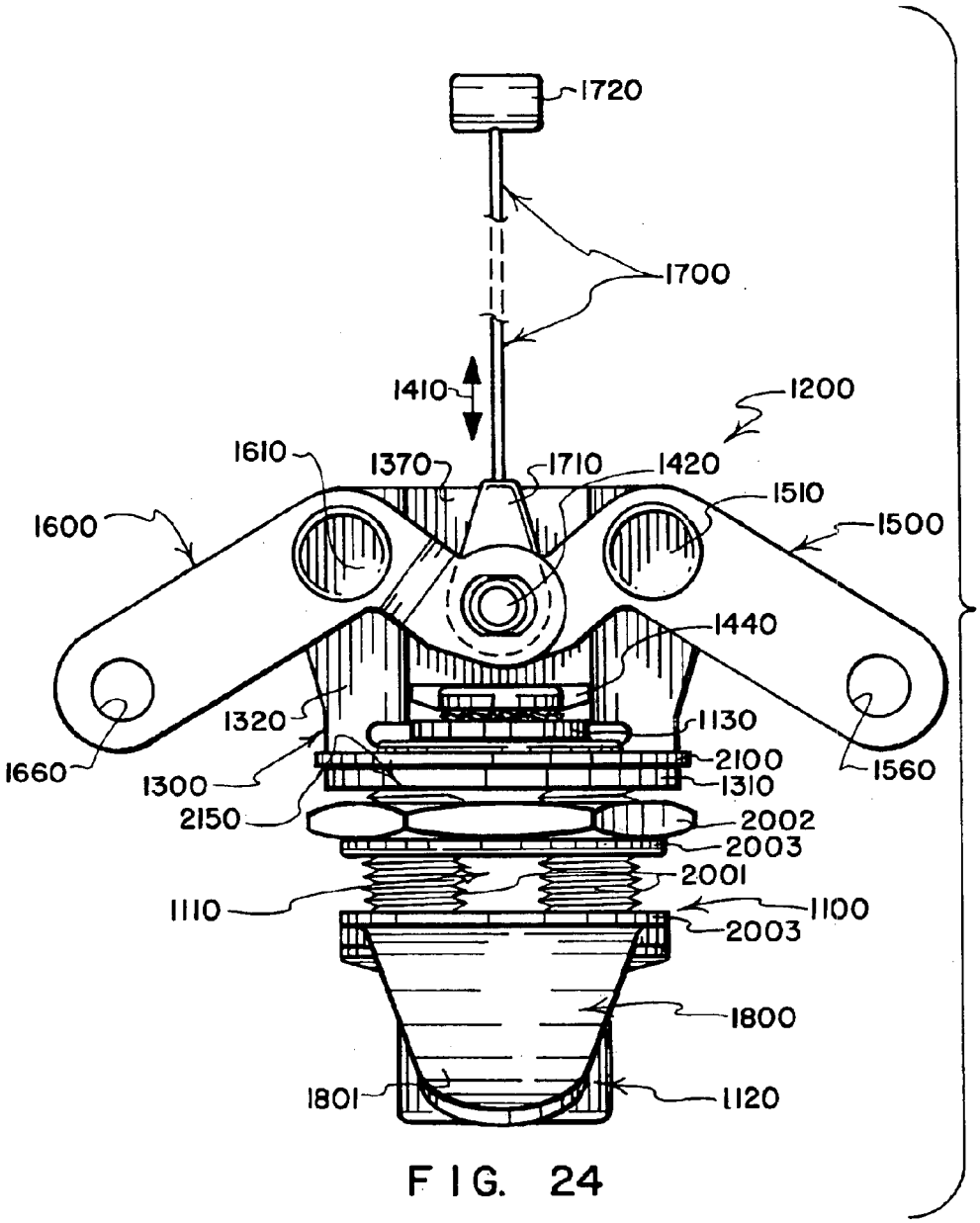
FIG. 24 is a front elevational view of the linkage assembly of FIGS. 10–23 installed on a push button assembly of the general type shown in FIGS. 1–7, with a manual release cable added to the linkage assembly, with a finger pull added to the push button assembly, and with the arms of the linkage assembly in their extended, non-operated positions.
Figure 25:
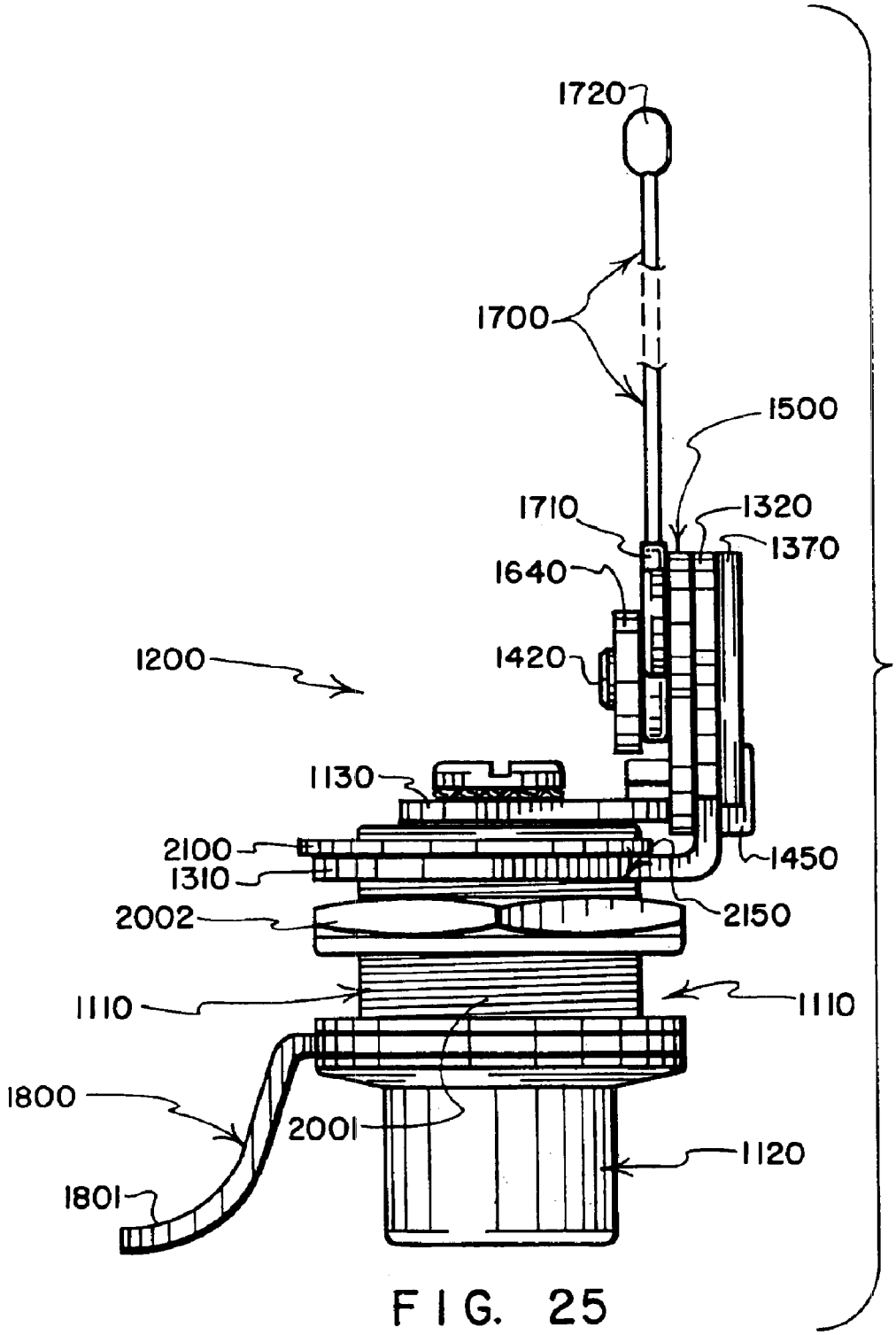
FIG. 25 is a right side view thereof.
Figure 26:
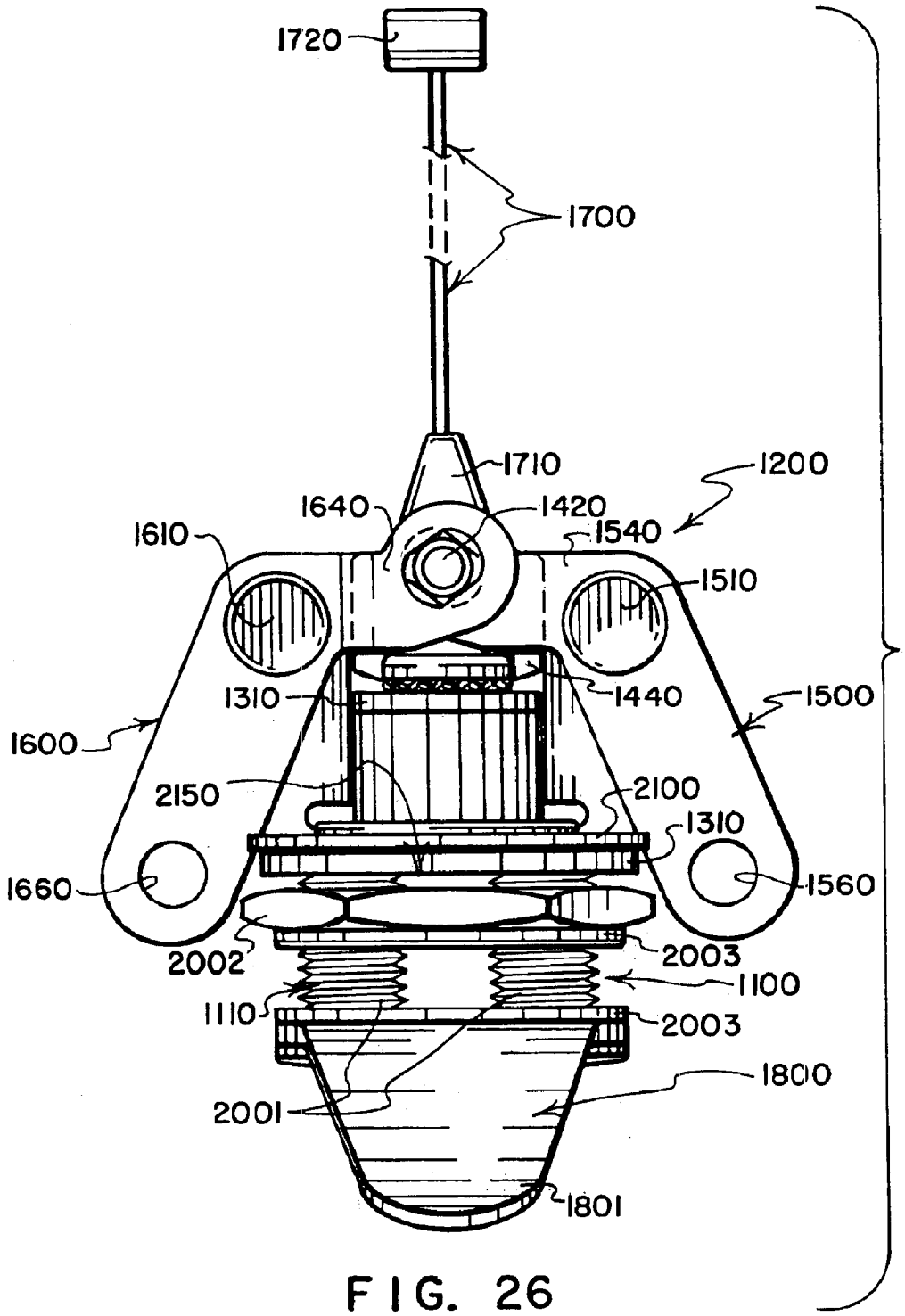
FIG. 26 is a front elevational view similar to FIG. 24 but with the arms of the linkage assembly in their retracted, operated positions in response to depression of the push button of the push button assembly; and, FIG. 27 is a right side view thereof.
Figure 27:
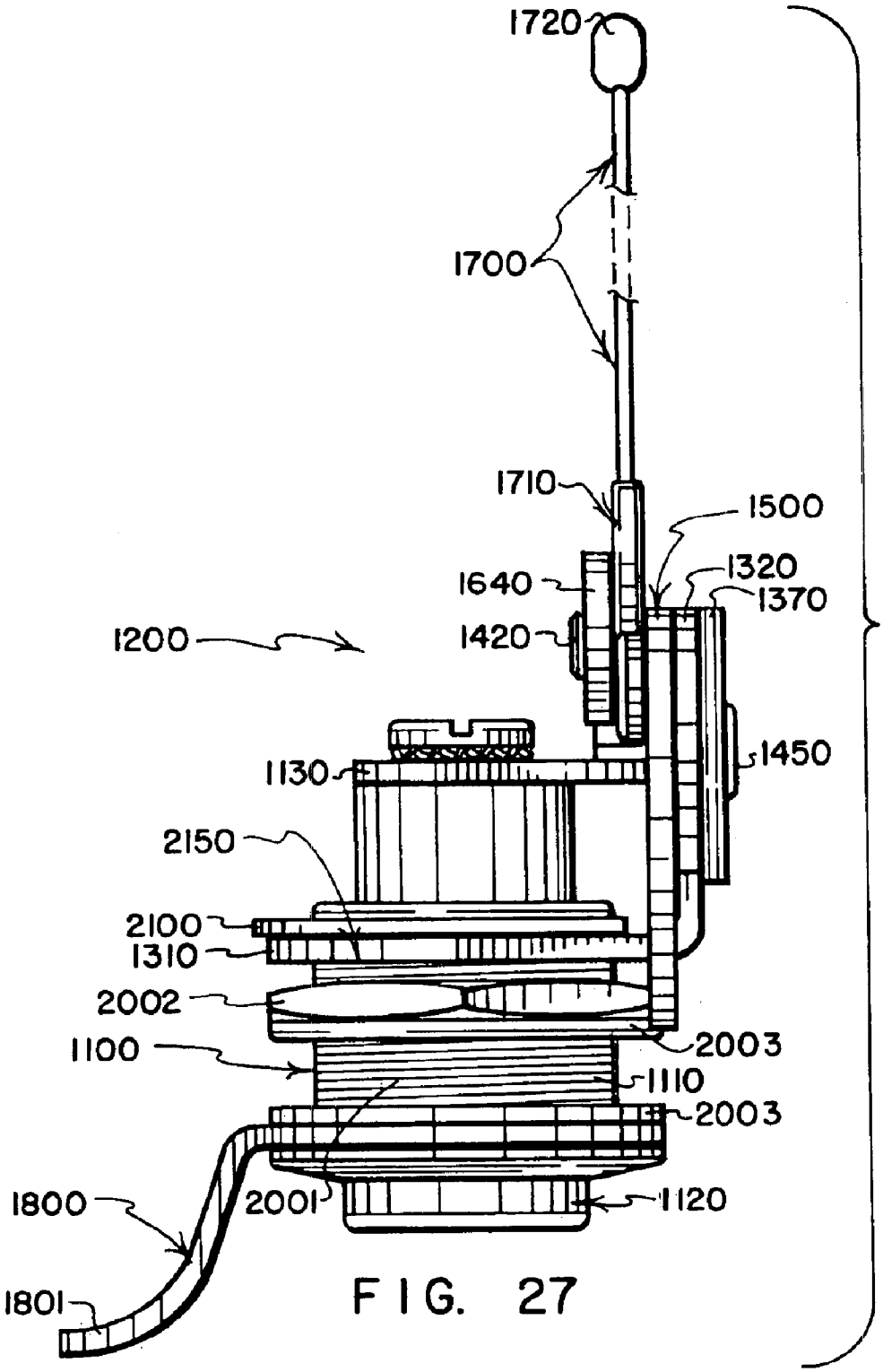

Referring to FIGS. 24–25, a push button assembly 1100 is shown connected to a linkage assembly 1200. The push button assembly 1100 is substantially the same as the push button assembly 100 (and the linkage assembly 1200 is substantially the same as the linkage assembly 200, as will be explained later herein). Just as the push button assembly 100 has a push button 120 that can be depressed through a housing 110 to move an actuator cam 130 between non-operated and operated positions, and can be rotated by a properly configured key to move the actuator cam 130 between locked and unlocked positions, the push button assembly 1100 has a push button 120 that can be depressed through a housing 1110 to move an actuator cam 1130 between non-operated and operated positions, and can be rotated by a properly configured key to move the actuator cam 1130 between locked and unlocked positions.

How the push button assemblies 100 and 1100 differ resides in the presence of additional features that are illustrated in FIGS. 24–27 on the push button assembly 1100—features that can also be provided on the push button assembly 1100 to make these assemblies identical—including the provision of threads 2001 on exterior surface portions of the housing 1110 onto which a hex nut 2002 is threaded for the purpose of clamping the housing 1110 onto a mounting panel (not shown) by clamping front and rear surfaces of the mounting panel between a pair of washers 2003 that ring portions of the housing 1110; the provision of a finger grip or "finger pull" plate 1800 that also rings portions of the housing 1110 and has a forwardly extending formation 1801 that can be grasped by one's finger when one is using one's thumb to operate the push button 1120; and the provision of spring steel e-clip 2100 that is installed on the housing 1110 to hold a leg 1310 of the frame 1300 of the linkage assembly 1200 in place on the housing 1110 against a shoulder of the housing that is indicated generally by the numeral 2150. The finger pull 1800 is, in preferred practice, identical to the "grasping element 100" disclosed in the referenced Tri/Mark Patent which also discloses a threaded housing, a hex nut and washers that are used to clamp a mounting panel, and a spring steel e-clip, all of which function in the same manner as these corresponding elements of the push button assembly 1100.

Stated in another way, the push button assemblies 100, 1100 depicted in the drawings hereof are typical of a number of commercially available push button assemblies that carry actuator cams that are pivotal between locked and unlocked positions, and that are movable forwardly and rearwardly with push button actuators. If other information regarding this general type of push button assembly is needed, it can be found in the referenced Eberhard and Tri/Mark Patents.

The drawings hereof show two very similar forms of linkage assemblies. Features of a first form, indicated generally by the numeral 200, are illustrated in FIG. 1–9. Features of a second form, indicated generally by the numeral 1200, are illustrated in FIGS. 10–27. The linkage assemblies 200, 1200 differ only subtly in the details of their configurations, for example: in the configuration of their arms 500, 600, 1500, 1600; in the relative positioning of their axes 420, 520, 620, 1420, 1520, 1620; and in the proportions and configurations of their other components.

The first and second forms 200, 1200 may be used with or without an emergency release member that can be grasped and moved to effect operation of one or more latches connected to the linkage assemblies 200, 1200. In FIGS. 1–7 the first form of linkage assembly 200 is shown having no emergency release member connected thereto; however, in FIGS. 8 and 9, the first form of linkage assembly 200 is shown with an emergency release member, namely an emergency release cable 700, connected thereto. In FIGS. 10–23 the second form of linkage assembly 1200 is shown having no emergency release member connected thereto; however, in FIGS. 24–27, the second form of linkage assembly 1200 is shown with an emergency release member, namely an emergency release cable 1700, connected thereto, that has an enlarged graspable end region 1720.

Because the first and second linkage assembly forms 200, 1200 have corresponding components that are very similarly configured and that function in substantially the same manner, corresponding numerals that differ by a magnitude of one thousand have been used to designate the components that correspond. By utilizing corresponding numerals that differ by a magnitude of one thousand to designate components of the linkage assemblies 200, 1200 that correspond in configuration, function and operation, at least some of the need to describe the features and components of the second linkage assembly 1200 by duplicating the description of the features and components of the first linkage assembly 200 is eliminated—it being understood that the description of each of the components of the first linkage assembly 200 applies equally to the correspondingly numbered components of the second linkage assembly 1200 unless stated otherwise.

Figure 9:
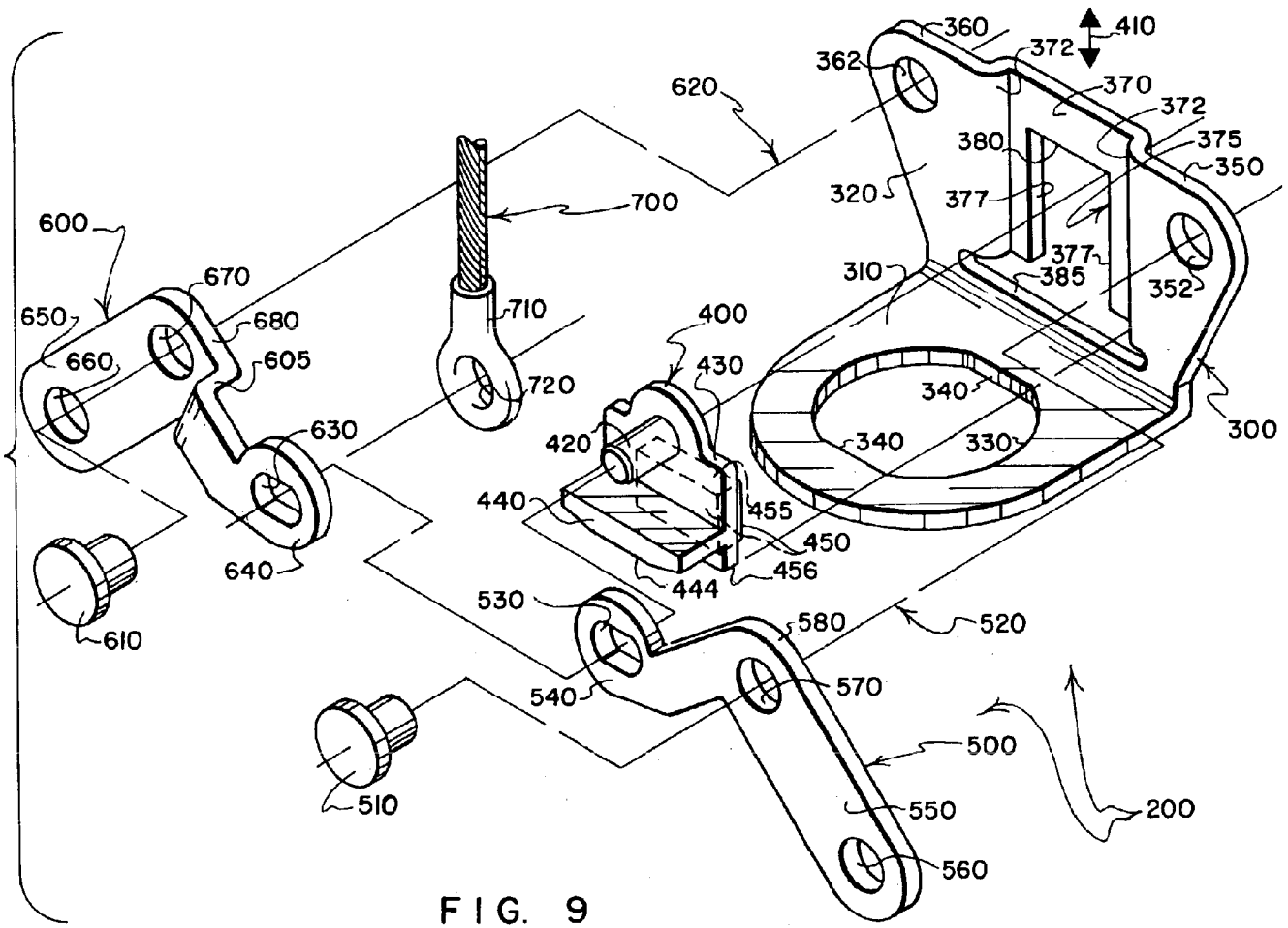
FIG. 9 is an exploded perspective view showing components of the linkage assembly including portions of an emergency release cable.
Figure 10:
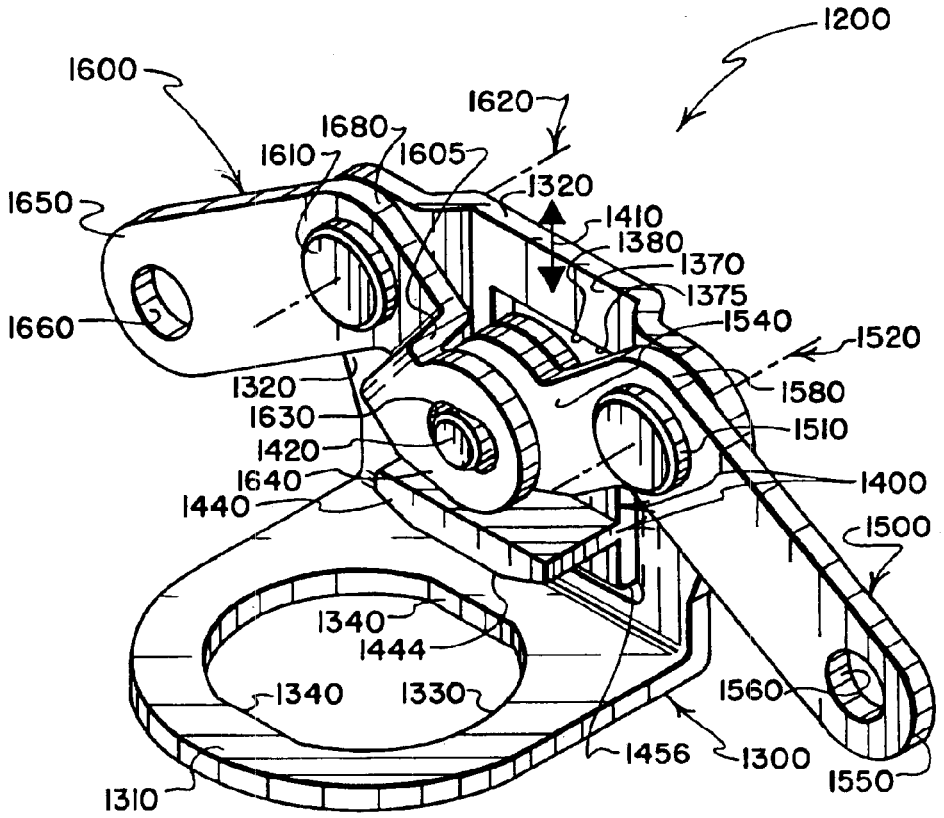
FIG. 10 is a perspective view showing a second form of linkage assembly embodying features of the present invention for use with push button latch and lock operating assemblies of the general type shown in FIGS. 1–7, with the arms thereof pivoted to their extended, non-operated positions.
Figure 11:
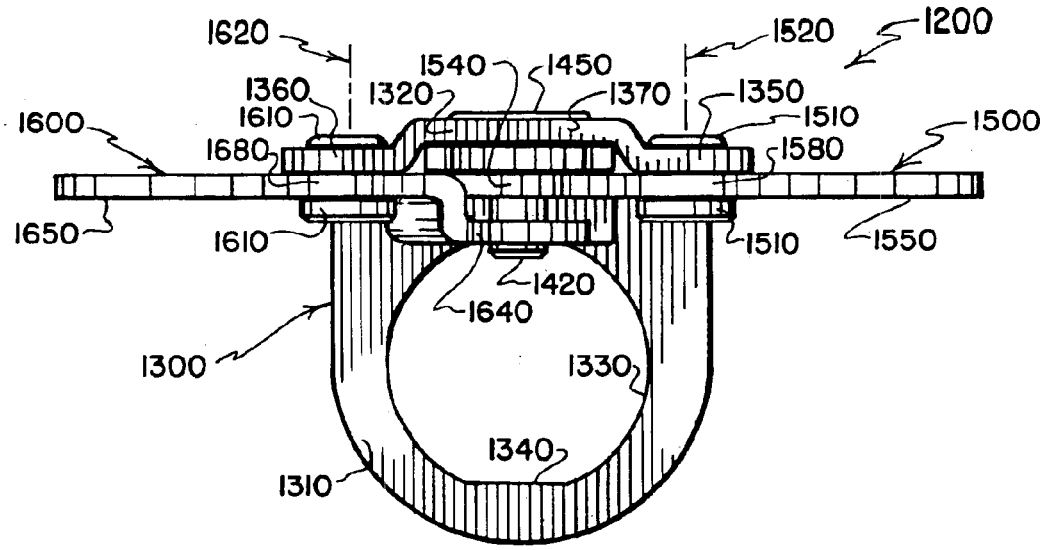
FIG. 11 is a top view thereof.
Figure 12:
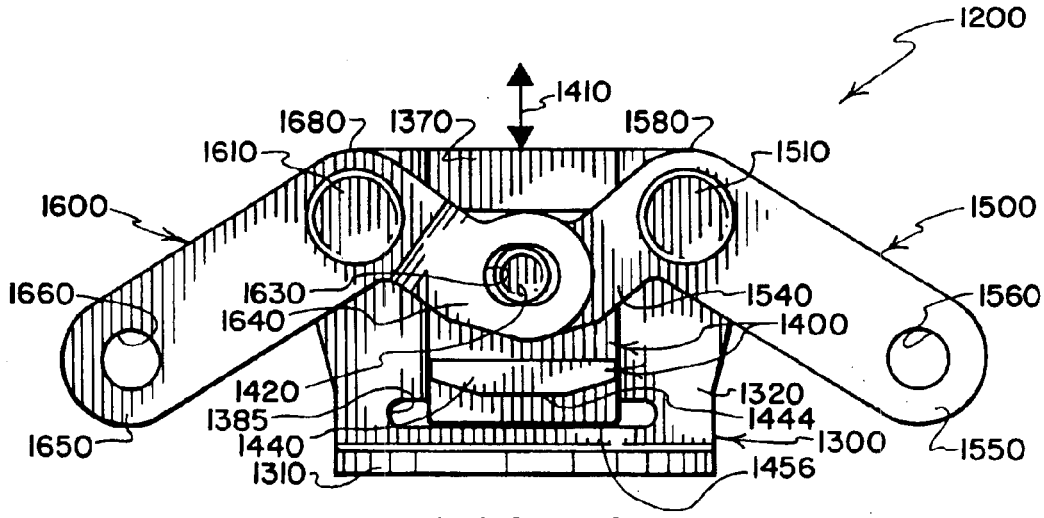
FIG. 12 is a front view thereof.
Figure 13:
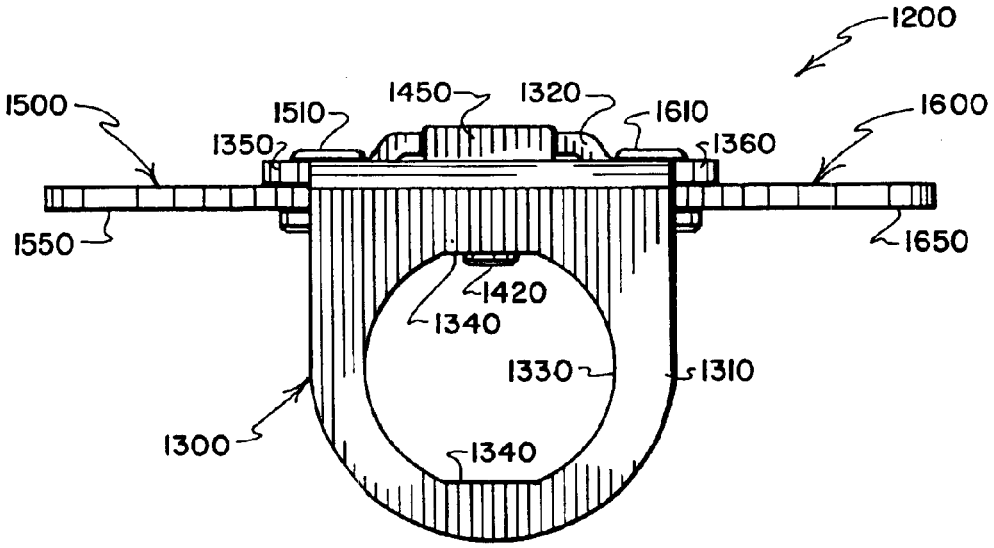
FIG. 13 is a bottom view thereof.
Figure 14:
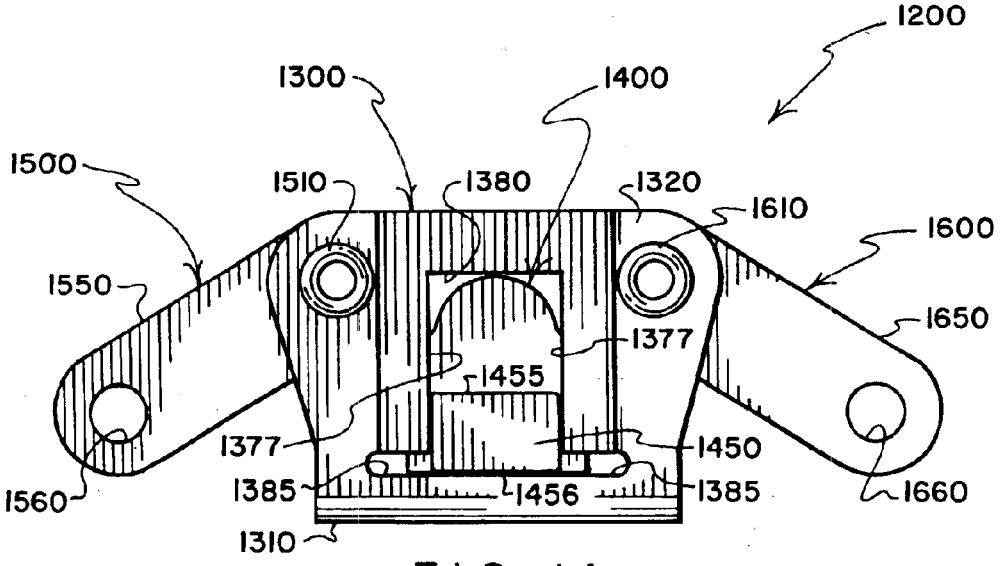
FIG. 14 is a rear view thereof.
Figure 15:
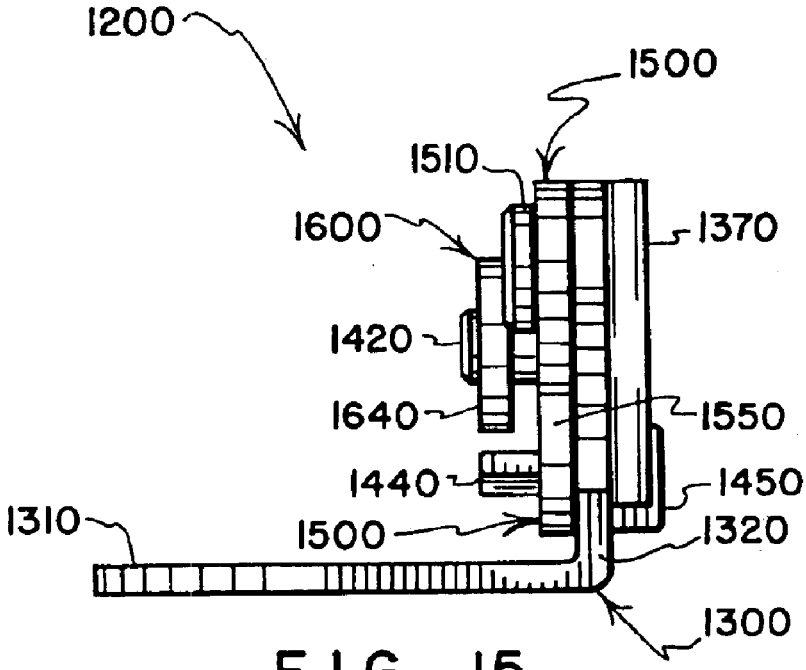
FIG. 15 is a right side view thereof.
Figure 16:
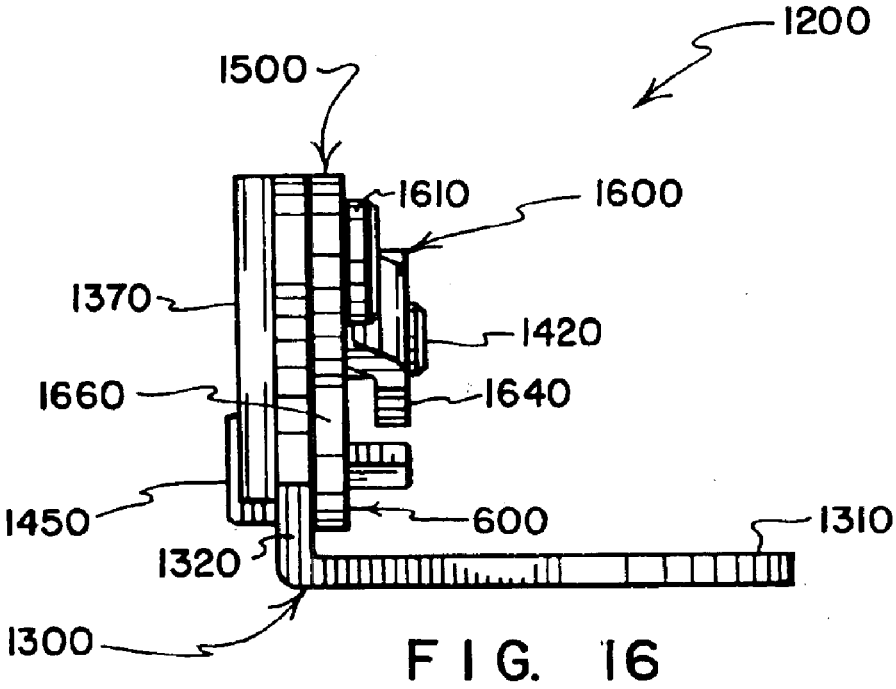
FIG. 16 is a left side view thereof.
Figure 17:
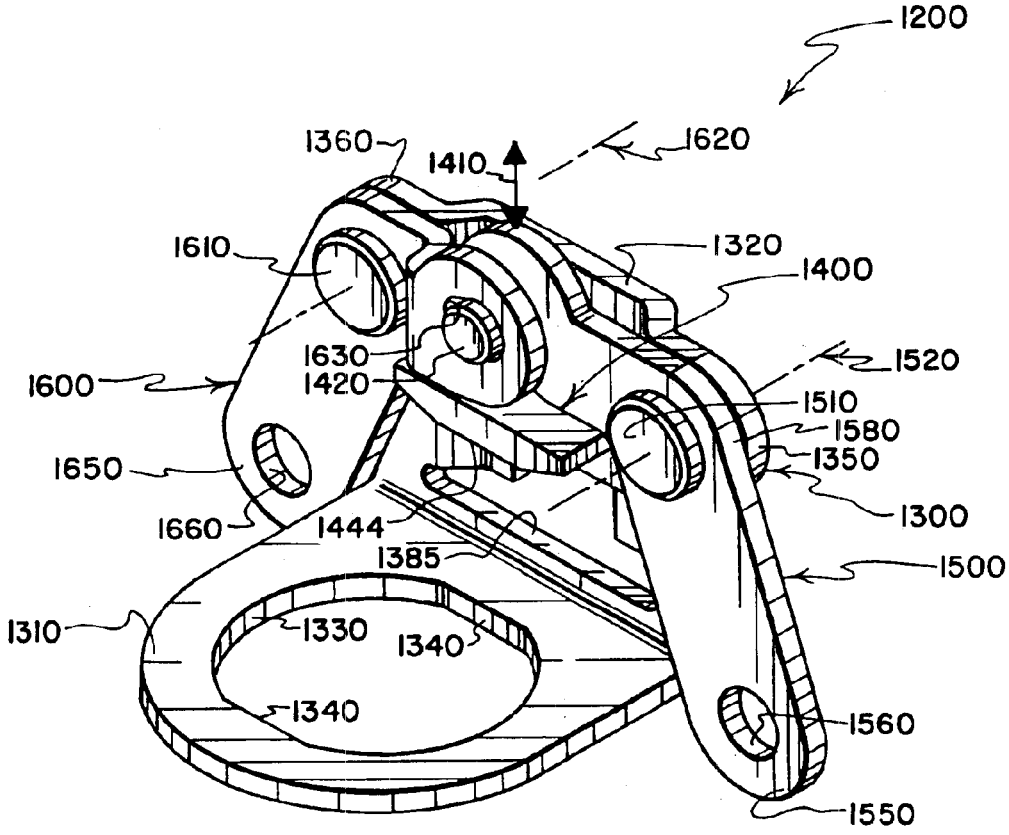
FIG. 17 is a perspective view similar to FIG. 10 but with the arms of the linkage assembly pivoted to their the linkage assembly pivoted to their retracted, operated positions.
Figure 18:
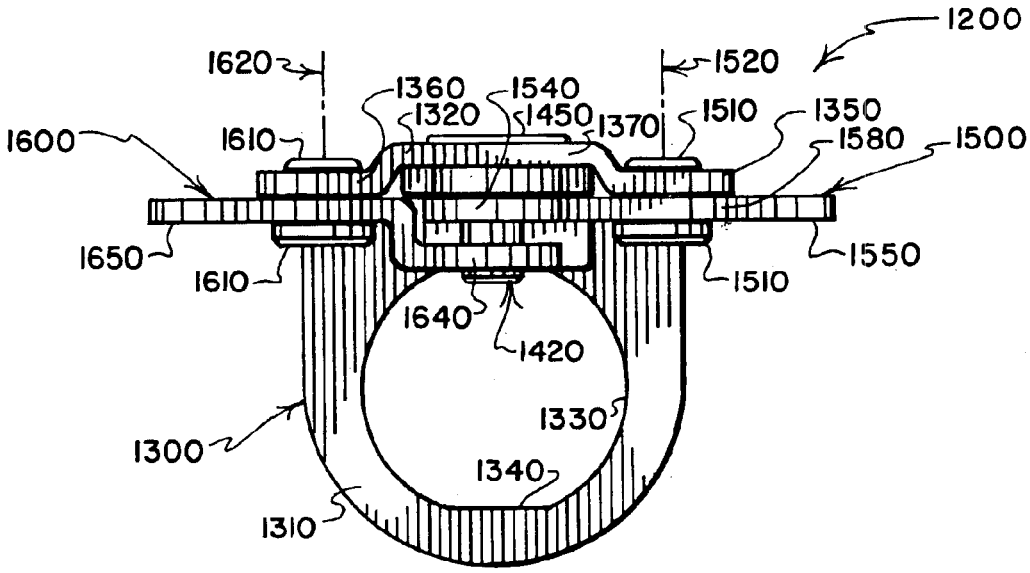
FIG. 18 is a top view thereof.
Figure 19:
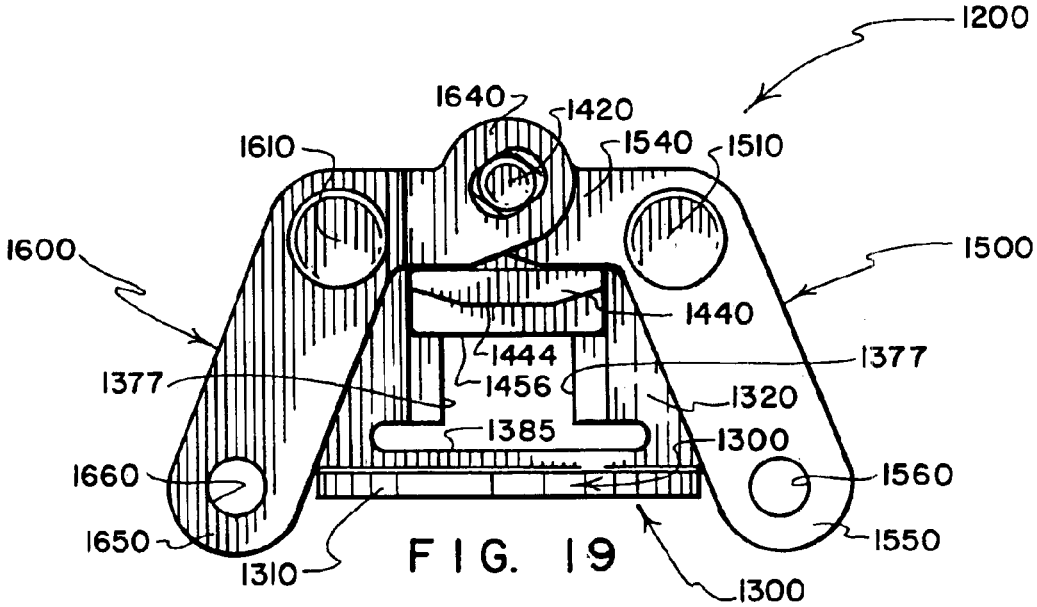
FIG. 19 is a front view thereof.
Figure 20:
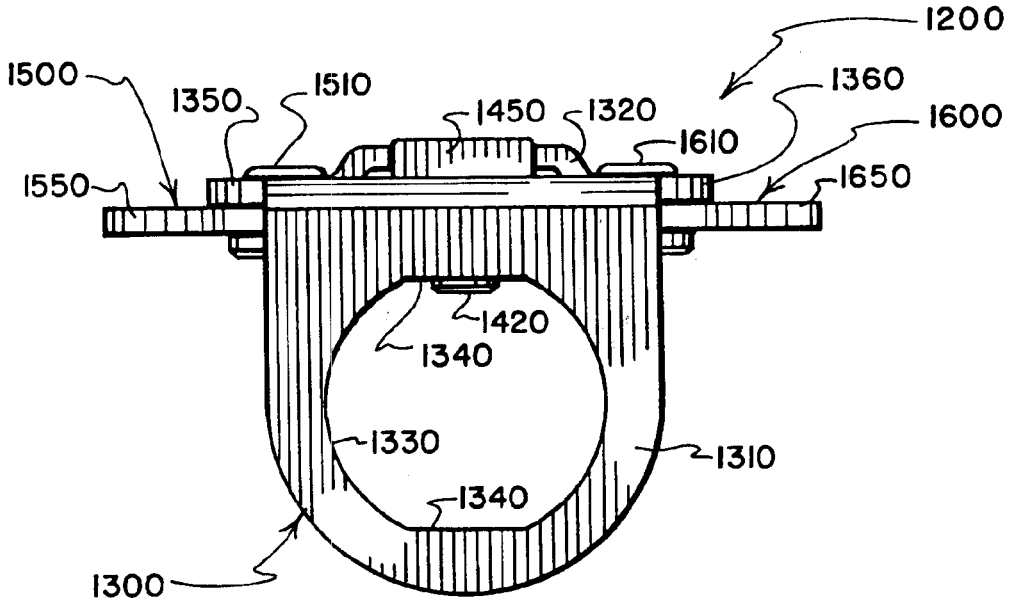
FIG. 20 is a bottom view thereof.
Figure 21:
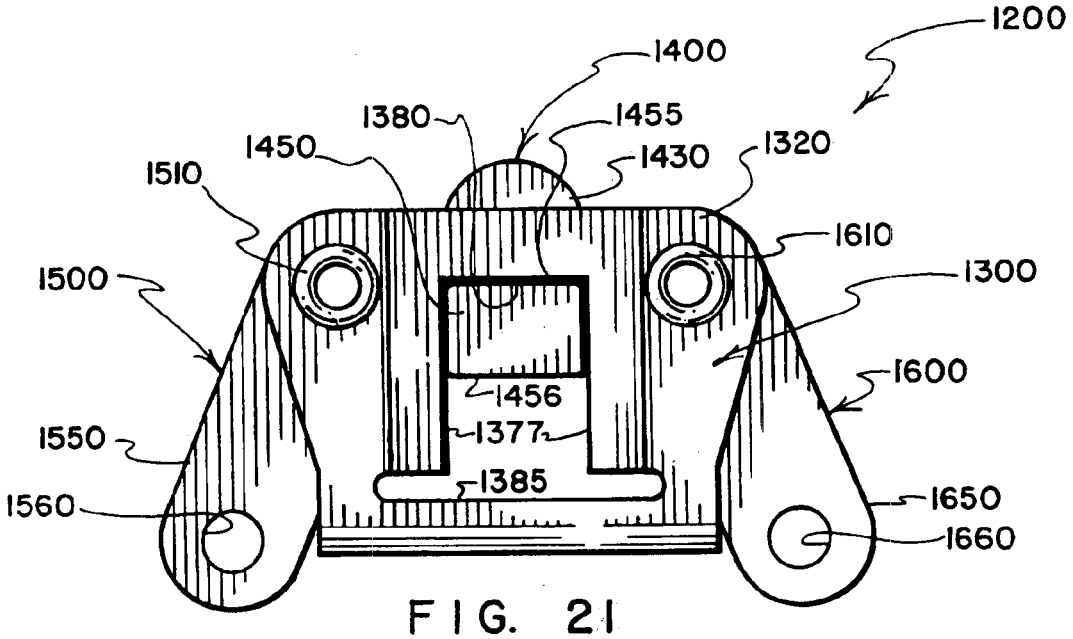
FIG. 21 is a rear view thereof.
Figure 22:
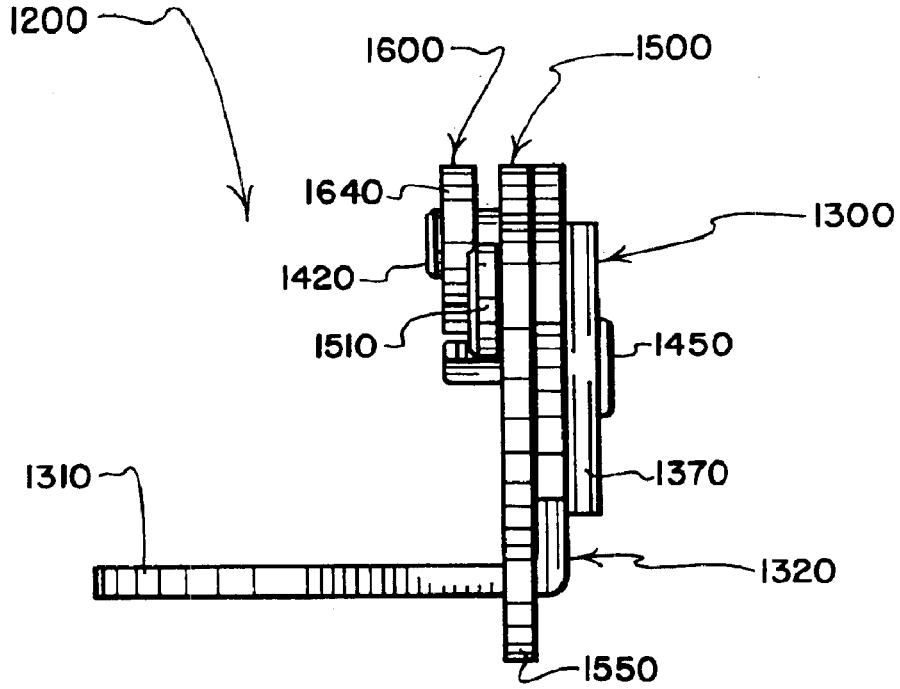
FIG. 22 is a right side view thereof.
Figure 23:
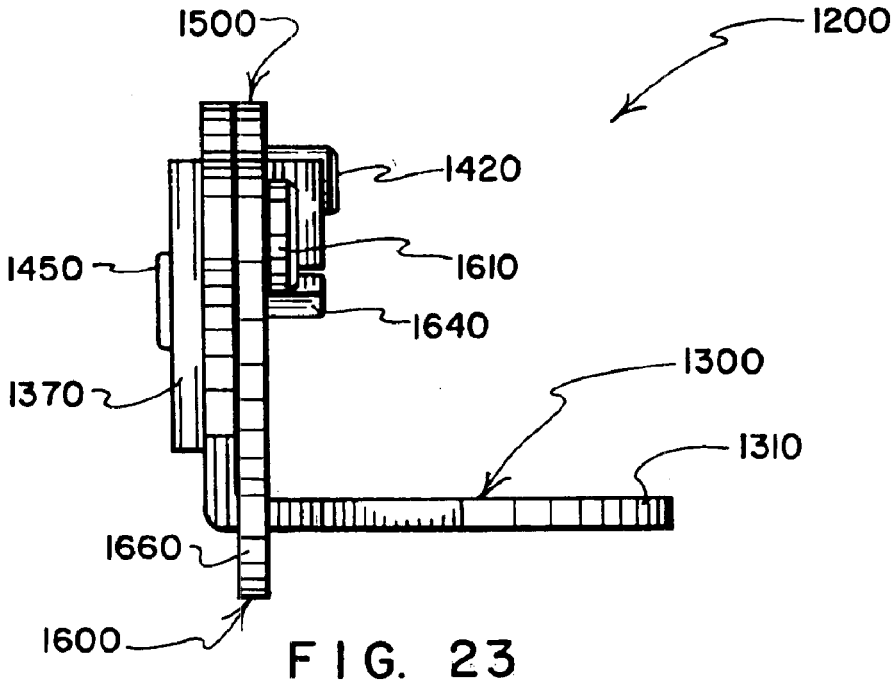
FIG. 23 is a left side view thereof.

Referring to FIGS. 1 and 9, the linkage assembly 200 includes a generally L-shaped frame 300 having a support leg 310 and a component mounting leg 320; a slide 400 supported by the component mounting leg 320 of the frame for translation along a path of travel indicated in FIGS. 1, 3 and 5 by arrows 410; and first and second arms 500, 600 that are pivotally connected to opposite side portions of the component mounting leg 320 of the frame 300 by rivets 510, 610 for pivotal movement about first and second axes 520, 620 that extend parallel to each other. Likewise, referring to FIG. 10, the linkage assembly 1200 includes a generally L-shaped frame 1300 having a support leg 1310 and a component mounting leg 1320; a slide 1400 supported by the component mounting leg 1320 of the frame for translation along a path of travel indicated in FIG. 10 by arrows 1410; and first and second arms 1500, 1600 that are pivotally connected to the component mounting leg 1320 of the frame 1300 by rivets 1510, 1610 for pivotal movement about first and second axes 1520, 1620 that extend parallel to each other.

The rivets 510, 610 constitute a "means" for pivotally mounting the arms 500, 600 on opposite side portions of the component mounting leg of the frame 200 for pivotal movement about axes 520, 620 that extend parallel to each other within a common plane at locations on opposite sides of the path of travel 410 of the slide 400. Likewise, that the rivets 1510, 1610 constitute a "means" for pivotally mounting the arms 1500, 1600 on the frame 1200 for pivotal movement about axes 1520, 1620 that extend parallel to each other within a common plane at locations on opposite sides of the path of travel 1410 of the slide 1400.

The arms 500, 600 can pivot between the extended, non-operated position shown in FIGS. 1, 3 and 5, and the retracted, operated position shown in FIG. 7 as the slide 400 moves in a coordinated manner between the retracted position shown in FIGS. 1, 3 and 5, and the extended position shown in FIG. 7; and, arm movement is coordinated by an elongate, pin-like formation 420 of the slide 400 that extends through openings 530, 630 formed in overlying inner end regions 540, 640 of the arms 500, 600. Likewise, the arms 1500, 1600 can pivot between the extended, non-operated position shown in FIGS. 10–16, 24 and 25, and the retracted, operated position shown in FIGS. 17–23, 26 and 27 as the slide 1400 moves in a coordinated manner between the retracted position shown in FIGS. 10–16, 24 and 25, and the extended position shown in FIGS. 17–23, 26 and 27; and, arm movement is coordinated by an elongate, pin-like formation 1420 of the slide 1400 that extends through openings 1530, 1630 formed in overlying inner end regions 1540, 1640 of the arms 1500, 1600.

Outer end regions 550, 650 of the arms 500, 600, and outer end regions 1550, 1650 of the arms 1500, 1600, are provided with connection holes 560, 660 and 1560, 1660, respectively, that can be used to connect latch operating links thereto in a manner that is illustrated in the referenced Eberhard and Tri/Mark Patents. Latches that are operated by links connected to the outer end regions 550, 650 of the arms 500, 600 and to the outer end regions 1550, 1650 of the arms 1500, 1600 can be of a wide variety of types, such as are disclosed in the referenced Eberhard and Tri/Mark Patents. Inasmuch as the linkage assemblies 200, 1200 can be used with a number of commercially available push button assemblies of the general type illustrated by the numeral 100 herein (and by the numeral 22 in the referenced Tri/Mark Patent), with a wide variety of links that connect with the outer end regions 550, 650, 1550, 1650 of the arms 500, 600, 1500, 1600 and with a wide variety of latches that are operated by links connected to the end regions 550, 650, 1550, 1650 of the arms 500, 600, 1500, 1600, and inasmuch as such push button assemblies, links and latches form no part of the present invention, the reader is referred to the Eberhard and Tri/Mark Patents (and to the other patents and applications referenced above) if more information is desired regarding these commercially available components of latch and lock systems.

Referring to FIG. 9, the L-shaped frame 300 has a relatively large opening 330 formed through the mounting leg 310 to receive the rear end region of a housing of a push button assembly—such as the rear end region of the housing 110 of the push button assembly 100 depicted in FIGS. 1–8. Likewise, referring to FIG. 10, the L-shaped frame 1300 has a relatively large opening 1330 formed through its mounting leg 1310 to receive the rear end region of a housing of a push button assembly—such as the rear end region of the housing 110 of the push button assembly 100 depicted in FIGS. 1–8.

The openings 330, 1330 may be provided with flat surface portions 340, 1340 to engage correspondingly configured flat surface portions of the housing of a push button assembly to prevent the L-shaped frames 300, 1300 from rotating on the housings of such push button assemblies. The mounting legs 310, 1310 may be held in place on the housing of a push button assembly with a simple spring clip of the type depicted in the Tri/Mark Patent and indicated in FIGS. 24–27 hereof by the numeral 2100, or with other suitable mounting means such as the clamp-type connectors disclosed in others of the pending applications listed above, and patents issued therefrom.

Figure 8:
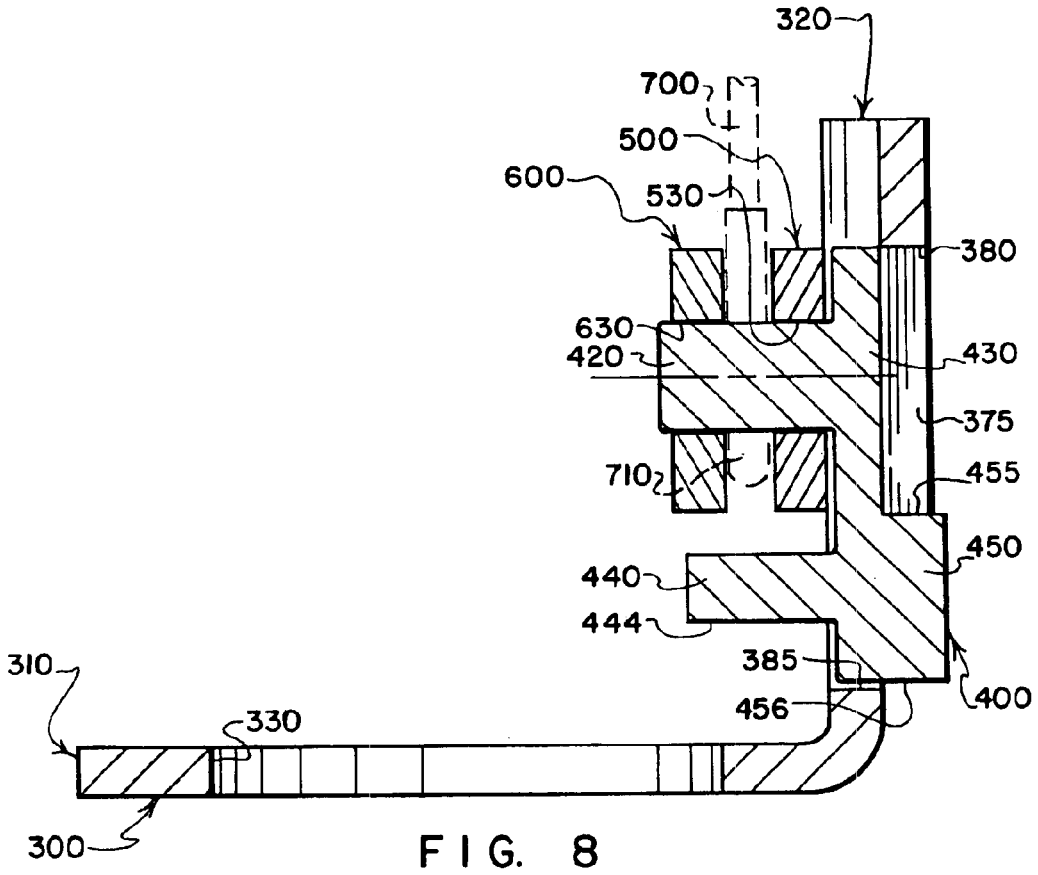
FIG. 8 is a sectional view, on an enlarged scale, as seen from a plane indicated by a line 8—8 in FIG. 7, with broken lines showing a location where an emergency release cable can be added by connecting it to a slide-carried pin at a location between overlapping inner end regions of the arms of the linkage assembly.

Referring to FIG. 9, the component mounting leg 320 of the L-shaped frame 300 has a depressed or offset central portion 370 that extends alongside the path of travel 410 of the slide 400, between opposite side portions 350, 360 of the component mounting leg 320. Opposed side walls 372 connect the depressed central portion 370 with the opposed side portions 350, 360 of the component mounting leg. Holes 352, 362 formed through the opposed side portions 350, 360 receive the rivets 510, 610 that extend through holes 570, 670 formed through central portions 580, 680 of the arms 500, 600 to establish pivotal connections between the frame 300 and the arms 500, 600. An opening 375 is formed through the depressed central portion 370 and extends along the path of travel 410 of the slide 400. Referring to FIG. 8, stop surfaces 380, 385 are defined by the component mounting leg 320 that are engaged by the slide 400 when the slide 400 is at opposite ends of its path of travel 410. The linkage assembly 1200 has features that correspond to the just-described features of the linkage assembly 200, which features are indicated in FIGS. 10–23 where applicable by numerals that correspond to those used just above, except that the corresponding numerals differ by a magnitude of one thousand from the numerals used just above.

Referring to FIG. 9, the slide 400 has a relatively flat central portion 430. Extending away from one side of the flat central portion 430 are the pin formation 420 and an abutment formation 440 having a front surface 444 that is engaged by the actuator cam 130 (see FIGS. 1, 3, 5 and 7) of the push button assembly 100 when the actuator cam 130 has been rotated to the unlocked position of FIG. 3 and when the actuator cam 130 has been moved rearwardly by the push button actuator 110, as depicted in FIG. 7. Opposed end regions of the surface 444 are inclined slightly relative to a plane in which central portions of the surface 444 extend, to aid in guiding the actuator cam 130 into engagement with the central portions of the surface 444 when the cam 130 is rotated from its locked position (out of engagement with the surface 444) to its unlocked position (in engagement with the surface 444).

Extending away from the other side of the flat central portion 430 of the slide 400 is a block-like formation 450 that slip-fits between opposite sides 377 of the opening 375 formed through the depressed central portion 370 to guide the slide 400 for movement along the path of travel 410. Referring to FIG. 8, an end surface 455 of the block-like formation 450 engages the stop surface 380 defined at the end of the opening 370 when the slide 400 is extended, as depicted in FIG. 7; and an end surface 456 of the slide 400 engages the stop surface 385 when the slide 400 is at the opposite end of its range of travel along the travel path 410. The linkage assembly 1200 has features that correspond to the just-described features of the linkage assembly 200, which features are indicated in FIGS. 10–23 where applicable by numerals that correspond to those used just above, except that the corresponding numerals differ by a magnitude of one thousand from the numerals used just above.

Referring to FIG. 9, while the arm 500 is substantially flat, the arm 600 has an offset or dogleg 605 located between its central region 680 and its inner end region 640. As is seen in FIGS. 3 and 5, when viewed from their sides, the arms 500, 600 have configurations that are mirror image reversals of each other, and pivot about the axes 520, 620 in a coordinated and "in unison" manner so that oppositely extending links connected to the outer end regions 550, 650 of the arms 500, 600 will be moved through equal distances when the arms 500, 600 pivot in response to translation of the slide 400 along its path of travel 410. The linkage assembly 1200 has features that correspond to the just-described features of the linkage assembly 200, which features are indicated in FIG. 10–23 where applicable by numerals that correspond to those used just above, except that the corresponding numerals differ by a magnitude of one thousand from the numerals used just above.

The primary device for moving the slide 400 along its path of travel 410 is the actuator cam 130 of the push button assembly 100; and, the primary device for moving the slide 1400 along its path of travel 1410 is a similar actuator cam of a similar push button assembly (not shown). Referring to FIGS. 8 and 9, a secondary device for moving the slide 400 along its path of travel is an emergency member which preferably takes the form of an release cable 700; and, referring to FIGS. 24–27, a secondary device for moving the slide 1400 along its path of travel is an emergency member which preferably takes the form of an release cable 1700. The release cables 700, 1700 preferably are identical, each having an end connector 710, 1710 that has a hole 720, 1720 formed therethrough that can be installed on the pin-like formation 420, 1420 of the associated slide 400, 1400 at a location between overlapping inner end regions 540, 640, 1540, 1640 of the arms 500, 600, 1500, 1600, and each having an enlarged graspable formation at the other ends thereof, one of which is indicated by the numeral 1720 in FIGS. 24–27.

When the cables 700, 1700 are pulled, the slides 400, 1400 are moved to their extended positions (shown in FIGS. 7, 26 and 27) and the arms 500, 600, 1500, 1600 are pivoted to operate such latches as may be connected to the arms 500, 600, 1500, 1600 by suitable links, typically of the general type disclosed in the referenced Eberhard and Tri/Mark Patents.

While significant features of the invention reside in the capability of the improved linkage mechanism to coordinate the movement of a pair of frame-pivoted arms that operate separate links connected to separate latches, advantages also reside in utilizing the improved linkage assembly of the present invention to operate a single latch connected by a single link to only one of the frame-pivoted arms. The engagement of the arm movement coordinating slide 400,

1400 with sizable surfaces areas of the frame 300, 1300 at opposite ends of its range of movement to "stop" or limit the range of movement of the arms is believed to be a more reliable and less wear-prone method of stopping or limiting the travel of the arms than is provided where the pivoted arms themselves make contact with relatively small formations defined by the frame; and, the direct engagement by the actuator cam with the slide 400, 1400 provides less wear to the assembled mechanism than is incurred if end regions of the arms slide across the cam as the cam moves rearwardly to cause pivoting of the arms—as occurs in the earlier designs disclosed in the referenced Eberhard and Tri/Mark Patents.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

What is claimed is:

1. A linkage assembly for moving a plurality of latch connected links to operate latches that are connected to the links in response to movement of an actuator along a path of movement defined by a housing to which the actuator is connected, comprising:

a) a generally right angle frame adapted for connection to the housing, said frame having a first leg and a second leg;

b) a first arm having a first outer end adapted for connection to one of the latch connected links, having a first inner end, and having a first central region located between the first inner end and the first outer end;

c) a second arm having a second outer end adapted for connection to another of the latch connected links, having a second inner end, and having a second central region located between the second inner end and the second outer end;

d) a slide connected to the first leg of the frame and adapted for being engaged by the actuator to be moved along a path of travel defined by the frame in response to movement of the actuator along the path of movement defined by the housing;

e) a pivot assembly connected to the frame, for defining a first pivot axis that extends through the first central region and about which the first arm pivots relative to the frame, and for defining a second pivot axis that extends through the second central region and about which the second arm pivots relative to the frame, wherein the first and second pivot axes are located on opposite sides of the path of travel of the slide at substantially equal distances from the path of travel of the slide, and wherein the first and second pivot axes extend substantially parallel to each other within a plane that extends substantially perpendicular to the path of travel of the slide;

f) a slide connection defining a third pivot axis that substantially parallels the first and second pivot axes and that extends through the first inner end region of the first arm and through the second inner end region of the second arm, and for concurrently pivoting the first and second arms about the first and second pivot axes, respectively, in response to movement of the slide along the path of travel of the slide to move the first and second outer end regions of the first and second arms to move the one and another links to operate latches connected to the one and another links in response to movement of the actuator along the path of movement of the actuator.

2. The linkage assembly of claim 1 additionally including an emergency release member connected to the slide and adapted to be grasped and moved manually to move the slide along the path of travel of the slide to move the first and second outer end regions in unison to cause the latches connected to the links to be operated.

3. The linkage assembly of claim 2 wherein the emergency release member includes a length of flexible cable having a graspable formation near one end region thereof, and having an opposite end region thereof connected to the slide.

4. The linkage assembly of claim 3 wherein the first inner end of the first arm has a first opening formed therethrough, wherein the second inner end of the second arm overlies the first inner end of the first arm and has a second opening formed therethrough that aligns, at least in part, with the first opening, wherein the means for being connected to the slide includes an elongate formation that extends through the first and second openings, and wherein the opposite end region of the flexible cable is connected to the elongate formation.

5. The linkage assembly of claim 4 wherein the opposite end region of the flexible cable is connected to the elongate formation at a location between the overlying first and second ends of the first and second arms.

6. The linkage assembly of claim 1 wherein the means for defining a first pivot axis and a second pivot axis includes a first member extending from the frame along the first pivot axis through a hole formed in the first central region of the first arm, and a second member extending from the frame along the second pivot axis through a hole formed in the second central region of the second arm.

7. The linkage assembly of claim 1 wherein the frame defines a pair of spaced abutment surfaces, wherein the slide is engageable with one of the abutment surfaces when moved along the path of travel of the slide to one end of a permitted range of travel of the slide, wherein the slide is engageable with the other of the abutment surfaces when moved along the path of travel of the slide to an opposite end of the permitted range of travel of the slide, and wherein the slide's engagement with the one and the other of the abutment surfaces serves to limit pivotal movement of the first and second arms to a desired permitted range of angular movement.

8. The linkage assembly of claim 7 wherein the abutment surfaces are defined at opposite ends of a frame-defined opening formed through the frame, and the slide has a formation that extends into the frame-defined opening to engage the one and other of the abutment surfaces when at opposite ends of the permitted range of travel of the slide.

9. The linkage assembly of claim 1 wherein the first and second outer ends and the first and second central regions of the first and second arms extend in a common plane, whereas the first and second inner ends extend in planes that are offset one from another to permit a selected one of the first and second inner ends to overlie the other of the first and second inner ends.

10. The linkage assembly of claim 9 wherein an emergency release member connects with the means for being connected to the frame at a location between the overlying first and second inner ends.

11. The linkage assembly of claim 1 wherein the actuator includes an actuator cam that is movable between locked and unlocked positions, and wherein the slide defines a formation that is configured to be engaged by the actuator cam when the actuator cam is in the unlocked position of the actuator cam, but not when the actuator cam is in its locked position.

12. The linkage assembly of claim 11 wherein the formation that is configured to be engaged by the actuator cam has a surface that is inclined slightly relative to a plane in which the actuator cam moves while traveling between the locked and unlocked positions of the actuator cam, and the inclined surface is oriented to guide the actuator cam into engagement with said formation of the slide when the actuator cam pivots from the locked position to the unlocked position of the actuator cam.

13. The linkage assembly of claim 1 wherein the first and second arms are pivotally connected to the first leg, and the second leg defines an opening adapted to receive portions of the housing.

14. The linkage assembly of claim 13 wherein the first leg has a centrally located portion that is offset from a common plane in which first and second opposite side portions of the first leg extend, wherein the first and second arms are pivotally connected to the first and second opposite side portions of the first leg, and wherein the slide is movable alongside the centrally located portion of the first leg between the first and second opposite side portions of the first leg.

15. A linkage assembly for moving a latch connected link to operate a latch that is connected to the link in response to movement of an actuator along a path of movement defined by a housing to which the actuator is connected, comprising:

a) a generally right angle frame adapted for connection to the housing, said frame having a first leg and a second leg;

b) a first arm having a first outer end adapted for connection to the link, having a first inner end, and having a first central region located between the first inner end and the first outer end;

c) a second arm having a second outer end adapted for connection to the link, having a second inner end, and having a second central region located between the second inner end and the second outer end;

d) a slide connected to the first leg of the frame and adapted to be engaged by the actuator to be moved along a path of travel defined by the frame in response to movement of the actuator along the path of movement defined by the housing;

e) a pivot assembly connected to the frame, for defining a first pivot axis that extends through the first central region and about which the first arm pivots relative to the frame, and for defining a second pivot axis that extends through the second central region and about which the second arm pivots relative to the frame, wherein the first and second pivot axes are located on opposite sides of the path of travel of the slide at substantially equal distances from the path of travel of the slide, and wherein the first and second pivot axes extend substantially parallel to each other within a plane that extends substantially perpendicular to the path of travel of the slide;

f) a slide connection defining a third pivot axis that substantially parallels the first and second pivot axes and that extends through the first inner end region of the first arm and through the second inner end region of the second arm, and for concurrently pivoting the first and second arms about the first and second pivot axes, respectively, in response to movement of the slide along the path of travel of the slide to move the first and second outer end regions of the first and second arms in unison in one direction away from each other to an extended position, and in unison in a second direction toward each other to a retracted position; and, g) means for connecting the link to a selected one of the first and second outer end regions of the first and second arms for causing the latch connected to the link to be operated when the selected one of the first and second outer end regions is moved in a selected one of the first and second directions.

16. The linkage assembly of claim 15 additionally including an emergency release member connected to the slide and adapted to be grasped and moved manually to move the slide along the path of travel of the slide to move the selected one of the first and second outer end regions in the selected one of the first and second directions to cause the latch connected to the link to be operated.

17. The linkage assembly of claim 16 wherein the emergency release member includes a length of flexible cable having a graspable formation near one end region thereof, and having an opposite end region thereof connected to the slide.

18. The linkage assembly of claim 17 wherein the first inner end of the first arm has a first opening formed therethrough, wherein the second inner end of the second arm overlies the first inner end of the first arm and has a second opening formed therethrough that aligns, at least in part, with the first opening, wherein the means for being connected to the slide includes an elongate formation that extends through the first and second openings, and wherein the opposite end region of the flexible cable is connected to the elongate formation.

19. The linkage assembly of claim 18 wherein the opposite end region of the flexible cable is connected to the elongate formation at a location between the overlying first and second ends of the first and second arms.

20. The linkage assembly of claim 15 wherein the means for defining a first pivot axis and a second pivot axis includes a first member extending from the frame along the first pivot axis through a hole formed in the first central region of the first arm, and a second member extending from the frame along the second pivot axis through a hole formed in the second central region of the second arm.

21. The linkage assembly of claim 15 wherein the frame defines a pair of spaced abutment surfaces, wherein the slide is engageable with one of the abutment surfaces when moved along the path of travel of the slide to one end of a permitted range of travel of the slide, wherein the slide is engageable with the other of the abutment surfaces when moved along the path of travel of the-slide to an opposite end of the permitted range of travel of the slide, and wherein the slide's engagement with the one and the other of the abutment surfaces serves to limit pivotal movement of the first and second arms to a desired permitted range of angular movement.

22. The linkage assembly of claim 21 wherein the abutment surfaces are defined at opposite ends of a frame-defined opening formed through the frame, and the slide has a formation that extends into the frame-defined opening to engage the one and other of the abutment surfaces when at opposite ends of the permitted range of travel of the slide.

23. The linkage assembly of claim 15 wherein the first and second outer ends and the first and second central regions of the first and second arms extend in a common plane, whereas the first and second inner ends extend in planes that are offset one from another to permit a selected one of the first and second inner ends to overlie the other of the first and second inner ends.

24. The linkage assembly of claim 23 wherein an emergency release member connects with the means for being connected to the face at a location between the overlying first and second inner ends.

25. The linkage assembly of claim 15 wherein the actuator includes an actuator cam that is movable between locked and unlocked positions, and wherein the slide defines a formation that is configured to be engaged by the actuator cam when the actuator cam is in the unlocked position of the actuator cam, but not when the actuator cam is in its unlocked position.

26. The linkage assembly of claim 25 wherein the formation that is configured to be engaged by the actuator cam has a surface that is inclined slightly relative to a plane in which the actuator cam moves while traveling between the locked and unlocked positions of the actuator cam, and the inclined surface is oriented to guide the actuator cam into engagement with said formation of the slide when the actuator cam pivots from the locked position to the unlocked position of the actuator cam.

27. The linkage assembly of claim 15 wherein the first and second arms are pivotally connected to the first leg, and the second leg defines an opening adapted to receive portions of the housing.

28. The linkage assembly of claim 27 wherein the first leg has a centrally located portion that is offset from a common plane in which first and second opposite side portions of the first leg extend, wherein the first and second arms are pivotally connected to the first and second opposite side portions of the first leg, and wherein the slide is movable alongside the centrally located portion of the first leg between the first and second opposite side portions of the first leg.

29. A linkage assembly for moving at least one latch connected link to operate at least one latch that is connected to the link in response to movement of a push button actuator along a path of movement defined by a housing to which the push button actuator is connected, comprising:

a) a frame adapted for connection to the housing;

b) at least one arm having an outer end adapted for connection to the latch connected link, having an inner end, and having a central region located between the inner end and the outer end;

c) a slide connected to the frame and adapted for being engaged by the actuator to be moved along a path of travel defined by the frame in response to movement of the push button actuator along the path of movement defined by the housing;

d) means for being connected to the frame, for defining one pivot axis that extends through the central region and about which the arm pivots relative to the frame, wherein the one pivot axis is located to one side of the path of travel of the slide, and wherein the one pivot axis extends within a plane that extends substantially perpendicular to the path of travel of the slide;

e) means for being connected to the slide, for defining another pivot axis that substantially parallels the one pivot axis and that extends through the inner end region of the arm and through the slide for pivoting the arm about the one pivot axis in response to movement of the slide along the path of travel of the slide to move the outer end region of the arm to move the link to operate a latch connected to the link in response to movement of the push button actuator along the path of movement of the push button actuator; and, f) a release cable connected to the means for being connected to the slide that can be pulled to move the slide along the path of travel of the slide to move the outer end region of the arm to move the link to operate the latch connected to the link without causing movement of the push button actuator along the path of movement of the push button actuator.

30. The linkage assembly of claim 29 wherein the inner end of the arm has an opening formed therethrough, and wherein the means for being connected to the slide includes an elongate formation that extends through the opening, and wherein the release cable is connected to the elongate formation.

31. The linkage assembly of claim 29 wherein the frame defines a pair of spaced abutment surfaces, wherein the slide is engageable with one of the abutment surfaces when moved along the path of travel of the slide to one end of a permitted range of travel of the slide, wherein the slide is engageable with the other of the abutment surfaces when moved along the path of travel of the slide to an opposite end of the permitted range of travel of the slide, and wherein the slide's engagement with the one and the other of the abutment surfaces serves to limit pivotal movement of the arm to a desired permitted range of angular movement.

32. The linkage assembly of claim 29 wherein the frame includes first and second legs that cooperate to define an L shape, the arm is pivotally connected to the first leg, and the second leg defines an opening adapted to receive portions of the housing.

33. A linkage assembly for moving a plurality of latch connected links to operate latches that are connected to the links in response to movement of an actuator along a path of movement defined by a housing to which the actuator is connected, comprising:

a) a generally rectangular frame adapted for connection to the housing, said frame having a first leg and a second leg;

b) a first arm having a first outer end adapted for connection to one of the latch connected links, having a first inner end, and having a first central region located between the first inner end and the first outer end, wherein the first outer end, the central region and the first inner end all extend within one plane;

c) a second arm having a second outer end adapted for connection to another of the latch connected links, having a second inner end, and having a second central region located between the second inner end and the second outer end, wherein the second outer end and the second central region extend in the one plane, and the second inner end extends in a second plane that parallels the one plane and overlaps the first inner end;

d) a slide connected to the first leg of the frame and adapted for being engaged by the actuator to be moved along a path of travel defined by the frame in response to movement of the actuator along the path of movement defined by the housing;

e) a pivot assembly connected to the frame, for defining a first pivot axis that extends through the first central region and about which the first arm pivots relative to the frame, and for defining a second pivot axis that extends through the second central region and about which the second arm pivots relative to the frame, wherein the first and second pivot axes are located on opposite sides of the path of travel of the slide at substantially equal distances from the path of travel of the slide, and wherein the first and second pivot axes extend substantially parallel to each other within another plane that extends substantially perpendicular to the path of travel of the slide; and, f) a slide connection defining a third pivot axis that substantially parallels the first and second pivot axes and that extends through the overlying inner end regions of the first and second arms, and for concurrently pivoting the first and second arms about the first and second pivot axes, respectively, in response to movement of the slide along the path of travel of the slide to move the first and second outer end regions of the first and second arms to move the one and another links to operate latches connected to the one and another links in response to movement of the actuator along the path of movement of the push button actuator.

34. The linkage assembly of claim 33 additionally including an emergency release member connected to the slide at a location between the overlying inner end regions of the first and second arms, and adapted to be grasped and moved manually to move the slide along the path of travel of the slide to move the first and second outer end regions in unison to cause the latches connected to the links to be operated.

35. The linkage assembly of claim 34 wherein the emergency release member includes a length of flexible cable having a graspable formation near one end region thereof, and having an opposite end region thereof connected to the slide.

36. The linkage assembly of claim 35 wherein the first inner end of the first arm has a first opening formed therethrough, wherein the second inner end of the second arm overlies the first inner end of the first arm and has a second opening formed therethrough that aligns, at least in part, with the first opening, wherein the means for being connected to the slide includes an elongate formation that extends through the first and second openings, and wherein the opposite end region of the flexible cable is connected to the elongate formation.

37. The linkage assembly of claim 33 wherein the means for defining a first pivot axis and a second pivot axis includes a first member extending from the frame along the first pivot axis through a hole formed in the first central region of the first arm, and a second member extending from the frame along the second pivot axis through a hole formed in the second central region of the second arm.

38. The linkage assembly of claim 33 wherein the frame defines a pair of spaced abutment surfaces, wherein the slide is engageable with one of the abutment surfaces when moved along the path of travel of the slide to one end of a permitted range of travel of the slide, wherein the slide is engageable with the other of the abutment surfaces when moved along the path of travel of the slide to an opposite end of the permitted range of travel of the slide, and wherein the slide's engagement with the one and the other of the abutment surfaces serves to limit pivotal movement of the first and second arms to a desired permitted range of angular movement.

39. The linkage assembly of claim 38 wherein the abutment surfaces are defined at opposite ends of a frame-defined opening formed through the frame, and the slide has a formation that extends into the frame defined opening to engage the one and other of the abutment surfaces when at opposite ends of the permitted range of travel of the slide.

40. The linkage assembly of claim 33 wherein the actuator includes an actuator cam that is movable between locked and unlocked positions, and wherein the slide defines a formation that is configured to be engaged by the actuator cam when the actuator cam is in the unlocked position of the actuator cam, but not when the actuator cam is in its unlocked position.

41. The linkage assembly of claim 40 wherein the formation that is configured to be engaged by the actuator cam has a surface that is inclined slightly relative to a plane in which the actuator cam moves while traveling between the locked and unlocked positions of the actuator cam, and the inclined surface is oriented to guide the actuator cam into engagement with said formation of the slide when the actuator cam pivots from the locked position to the unlocked position of the actuator cam.

42. The linkage assembly of claim 33 wherein the first and second arms are pivotally connected to the first leg, and the second leg defines an opening adapted to receive portions of the housing.

43. The linkage assembly of claim 42 wherein the first leg has a centrally located portion that is offset from a common plane in which first and second opposite side portions of the first leg extend, wherein the first and second arms are pivotally connected to the first and second opposite side portions of the first leg, and wherein the slide is movable alongside the centrally located portion of the first leg between the first and second opposite side portions of the first leg.

44. A linkage assembly for operating a latch, comprising:

a) a frame having first and second legs made from substantially flat material so that the first and second legs cooperatively define an L shape;

b) a first arm attached to the first leg of the frame for pivoting movement relative to the frame around a first axis between retracted and extended positions of the first arm, and having a first inner end and a first outer end adapted to be connected by a link to a first latch to effect operation of the first latch as an incident of the first arm moving from a selected one of the retracted and extended positions to the other of the retracted and extended positions;

c) a slide slidably engaging the first leg for movement along a path of travel of the slide that is transverse to said first axis, and pivotally connected to the first inner end region of the first arm for pivoting the first arm about the first axis in response to movement of the slide along the path of travel of the slide;

d) a housing attached to the second leg; and, e) a push button actuator supported in the housing for movement relative to the frame and the housing between normal and actuating positions along a path of travel of the push button actuator that is transverse to said first axis and that aligns with the path of travel of the slide, wherein movement of the push button actuator along the path of travel of the actuator from the normal position to the actuating position causes engagement of the actuator with the slide to move the slide along the path of travel of the slide to pivot the first arm about the first axis.

45. The linkage assembly of claim 44 further comprising a second arm attached to the first leg of the frame for pivoting movement relative to the frame around a second axis between retracted and extended positions of the second arm, and having a second inner end pivotally connected to the slide and a second outer end adapted to be connected by a link to a second latch to effect operation of the second latch as an incident of the second arm moving from a selected one of the retracted and extended positions of the second arm to the other of the retracted and extended positions of the second arm in response to movement of the slide along the path of travel of the slide.

46. The linkage assembly of claim 45 wherein the first and second axes reside within a single plane, and the path of travel of the actuator is orthogonal to said single plane.

47. The linkage assembly of claim 44 wherein the first and second legs of the frame are formed as one piece.

48. The linkage assembly of claim 47 wherein the first leg has a centrally located portion that is offset from a common plane in which first and second opposite side portions of the first leg extend, wherein the first and second arms are pivotally connected to the first and second opposite side portions of the first leg, and wherein the slide is movable alongside the centrally located portion of the first leg between the first and second opposite side portions of the first leg.

* * * * *